US008985275B2

(12) United States Patent
Solhjem et al.

(10) Patent No.: US 8,985,275 B2
(45) Date of Patent: Mar. 24, 2015

(54) LIFT SAFETY SYSTEM

(71) Applicant: Reechcraft, Inc., Fargo, ND (US)

(72) Inventors: Jason M. Solhjem, Kindred, ND (US); Shane L. Nickel, Fargo, ND (US)

(73) Assignee: Reechcraft, Inc., Fargo, ND (US)

( * ) Notice: Subject to any disclaimer, the term of this patent is extended or adjusted under 35 U.S.C. 154(b) by 0 days.

(21) Appl. No.: 14/517,534

(22) Filed: Oct. 17, 2014

(65) Prior Publication Data

US 2015/0034417 A1 Feb. 5, 2015

Related U.S. Application Data

(63) Continuation of application No. 13/536,140, filed on Jun. 28, 2012, now Pat. No. 8,863,899.

(60) Provisional application No. 61/502,421, filed on Jun. 29, 2011.

(51) Int. Cl.

| | |
|---|---|
| ***E04G 1/22*** | (2006.01) |
| ***B66F 11/04*** | (2006.01) |
| ***E04G 1/20*** | (2006.01) |
| ***E04G 1/24*** | (2006.01) |

(52) U.S. Cl.

CPC . *B66F 11/04* (2013.01); *E04G 1/20* (2013.01); *E04G 1/24* (2013.01); *E04G 2001/242* (2013.01)

USPC ..... 182/69.6; 182/141; 182/148; 182/63.1; 182/19; 187/240; 187/244

(58) Field of Classification Search

USPC ..... 182/63.1, 69.4, 69.6, 141, 148, 15, 17, 182/112, 113, 189, 133, 127, 19; 187/240, 187/243, 244

See application file for complete search history.

(56) References Cited

U.S. PATENT DOCUMENTS

| | | | | |
|---|---|---|---|---|
| 3,807,575 | A | 4/1974 | Merrick | |
| 3,957,137 | A | 5/1976 | Vermette | |
| 4,084,777 | A * | 4/1978 | Lambert | 248/287.1 |
| 4,131,181 | A | 12/1978 | Vermette | |
| 4,294,332 | A | 10/1981 | Ready | |
| 4,295,670 | A | 10/1981 | Goodall | |
| 4,421,209 | A | 12/1983 | Vermette | |
| 4,427,093 | A | 1/1984 | Wehmeyer | |

(Continued)

OTHER PUBLICATIONS

Faster Access for Low Rise Jobs, Power Pole by ReechCraft, Downloaded and Printed on Jun. 14, 2012.

(Continued)

*Primary Examiner* — Daniel Cahn
(74) *Attorney, Agent, or Firm* — Michael S. Neustel

(57) ABSTRACT

A lift safety system that prevents the lifting of a support platform from a support base until all of the support legs for the support base are supporting a minimum amount of weight to ensure stability of the lift. The support base includes a plurality of legs that extend outwardly with each of the legs having an adjustment member with a pad that engages a ground surface. As the adjustment member is adjusted downwardly with respect to the leg, a first engaging member connected to the adjustment member is elevated upwardly to engage a second engaging member thereby releasing a corresponding finger member attached to the support platform from the support base. Once all of the legs are supporting a minimum amount of weight, all of the finger members are released from the support base thereby allowing elevation of the support platform.

20 Claims, 19 Drawing Sheets

(56) References Cited

U.S. PATENT DOCUMENTS

| | | | | | |
|---|---|---|---|---|---|
| 4,498,556 | A | | 2/1985 | Garton | |
| 4,499,971 | A | * | 2/1985 | Luebrecht et al. | 187/223 |
| 4,552,403 | A | | 11/1985 | Yindra | |
| 4,588,346 | A | | 5/1986 | Smith | |
| 4,600,085 | A | | 7/1986 | Gagnon | |
| 4,887,694 | A | | 12/1989 | Ho | |
| 4,967,733 | A | | 11/1990 | Rousseau | |
| 5,111,907 | A | | 5/1992 | Kishi | |
| 5,121,816 | A | * | 6/1992 | Curtin | 187/243 |
| 5,159,989 | A | * | 11/1992 | Claxton | 180/41 |
| 5,310,018 | A | | 5/1994 | Lahaie | |
| 5,337,858 | A | * | 8/1994 | Neubauer et al. | 182/148 |
| 5,584,363 | A | * | 12/1996 | Curtin et al. | 187/243 |
| 5,875,869 | A | * | 3/1999 | Busuttil et al. | 182/69.6 |
| 6,119,605 | A | | 9/2000 | Agee | |
| 6,173,810 | B1 | * | 1/2001 | Citron et al. | 182/18 |
| 6,247,273 | B1 | | 6/2001 | Nickel | |
| 6,401,864 | B1 | * | 6/2002 | Stringer et al. | 182/148 |
| 6,523,647 | B2 | | 2/2003 | Duplessis | |
| 6,676,233 | B1 | | 1/2004 | Evans | |
| 6,793,039 | B2 | | 9/2004 | Schmid, Jr. | |
| 6,811,161 | B1 | * | 11/2004 | Anderson | 280/4 |
| 6,872,039 | B2 | | 3/2005 | Baus | |
| 6,981,573 | B2 | | 1/2006 | Nickel | |
| 7,090,051 | B2 | | 8/2006 | Robillard | |
| 8,079,444 | B1 | | 12/2011 | Rands | |
| 8,251,177 | B2 | | 8/2012 | Watt | |
| 8,505,684 | B1 | * | 8/2013 | Bogue | 182/19 |
| 2004/0069568 | A1 | | 4/2004 | Wyse | |
| 2006/0162999 | A1 | | 7/2006 | Atkins | |
| 2009/0266648 | A1 | | 10/2009 | Asensio Bazterra et al. | |
| 2012/0318610 | A1 | * | 12/2012 | Cummings | 182/18 |
| 2013/0292204 | A1 | * | 11/2013 | Bonanno et al. | 182/19 |

OTHER PUBLICATIONS

Power Pole by ReechCraft, User Manual, Downloaded and Printed on Jun. 14, 2012.

PCT Search Report, Received Jan. 22, 2013.

* cited by examiner

LIFT SAFETY SYSTEM

CROSS REFERENCE TO RELATED APPLICATIONS

I hereby claim benefit under Title 35, United States Code, Section 120 of U.S. patent application Ser. No. 13/536,140 filed Jun. 28, 2012. This application is a continuation of the Ser. No. 13/536,140 application. The Ser. No. 13/536,140 application is currently pending and is scheduled to be granted on Oct. 21, 2014 with a patent number of U.S. Pat. No. 8,863,899. The Ser. No. 13/536,140 application is hereby incorporated by reference into this application. The Ser. No. 13/536,140 application claims priority to U.S. Provisional Application No. 61/502,421.

I hereby claim benefit under Title 35, United States Code, Section 119(e) of U.S. provisional patent application Ser. No. 61/502,421 filed Jun. 29, 2011. The 61/502,421 application is now abandoned. The 61/502,421 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a portable lift and more specifically it relates to a portable modular lift system that may be easily transported to a lifting location and compactly stored when not in use.

2. Description of the Related Art

Any discussion of the related art throughout the specification should in no way be considered as an admission that such related art is widely known or forms part of common general knowledge in the field.

Conventional lift systems have been in use for years for elevating workers, materials and the like to elevated locations. Lift systems are utilized by maintenance workers, sound and light professionals, home owners, warehouse owners and the like to reach elevated locations. Conventional lift systems utilize one or more vertically orientated masts. The masts are typically attached to the side or wall of the structure to be worked upon with bracing. The masts may be comprised of a unitary structure or a modular structure. The modular masts are comprised of mast sections that are secured together in a vertical manner with conventional fasteners to form an elongated mast structure. A support platform is movably positioned upon the masts and may be elevated/lowered utilizing an electric motor or other power source. An example of a unitary mast configuration utilized for elevating workers and materials is U.S. Pat. No. 6,981,573 to Nickel and owned by Reechcraft, Inc. The Reechcraft patent discloses a pair of vertical posts that support a movable platform between thereof and that utilizes braces attached between the posts and the wall structure.

One problem with conventional lift systems is that they are relatively heavy making them difficult to transport to a work area. Another problem with conventional lift systems is that they are time consuming to assemble because they require tools and manual assembly with fasteners to attach the modular masts together.

A further problem with conventional lift systems is that they are difficult to transport and are not designed to be easily utilized in smaller sized locations like the interiors of buildings. Another problem with conventional lift systems is that they typically require more than one worker to assemble, utilize and disassemble. A further problem with conventional lift systems is that they require attachment of the masts to the side of a building structure being worked upon. Another problem with conventional lift systems is that they are expensive and complex making them difficult to utilize on smaller projects.

Because of the inherent problems with the related art, there is a need for a new and improved portable modular lift system that may be easily transported to a lifting location and compactly stored when not in use.

BRIEF SUMMARY OF THE INVENTION

The invention generally relates to a portable lift which includes a support base having a plurality of base wheels, a plurality of mast sections connectable to one another to form a vertical mast, a support platform movably positioned upon the vertical mast, and a drive unit connected to the support platform to elevate and lower the support platform upon the mast sections. The mast sections include a plurality of receiver apertures within a first end and a plurality of locking pins extending from a second end that are catchably received within the corresponding receiver apertures.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
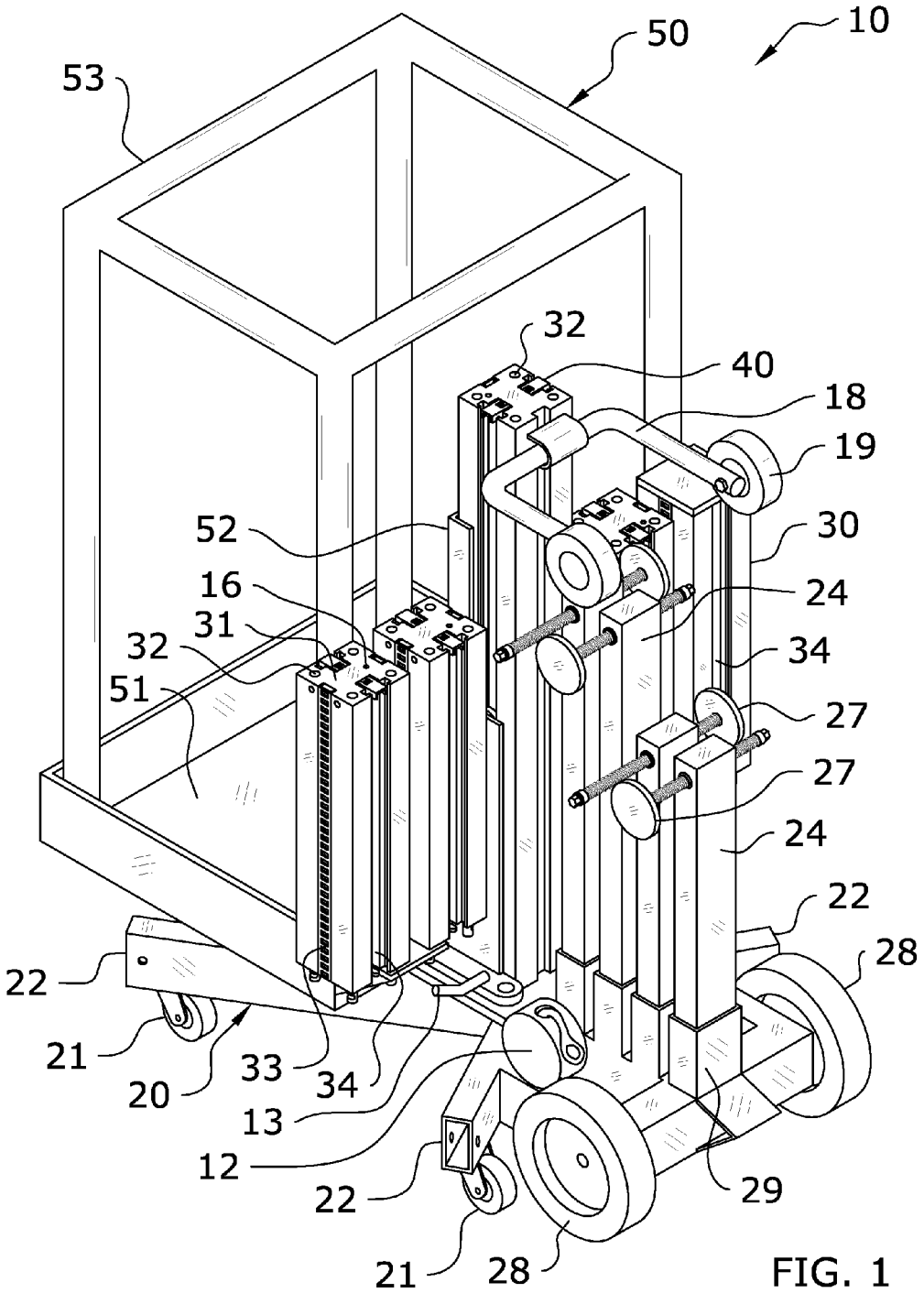
FIG. 1 is an upper perspective view of the present invention in a compact storage position.

A. Overview.

Turning now descriptively to the drawings, in which similar reference characters denote similar elements throughout the several views, FIGS. 1 through 13*c* illustrate a portable modular lift system 10, which comprises a support base 20 having a plurality of base wheels 28, a plurality of mast sections 30 connectable to one another to form a vertical mast, a support platform 50 movably positioned upon the vertical mast, and a drive unit 60 connected to the support platform 50 to elevate and lower the support platform 50 upon the mast sections 30. The mast sections 30 include a plurality of receiver apertures 32 within a first end 31 and a plurality of locking pins 38 extending from a second end 37 that are catchably received within the corresponding receiver apertures 32.

B. Support Base.

Figure 2:
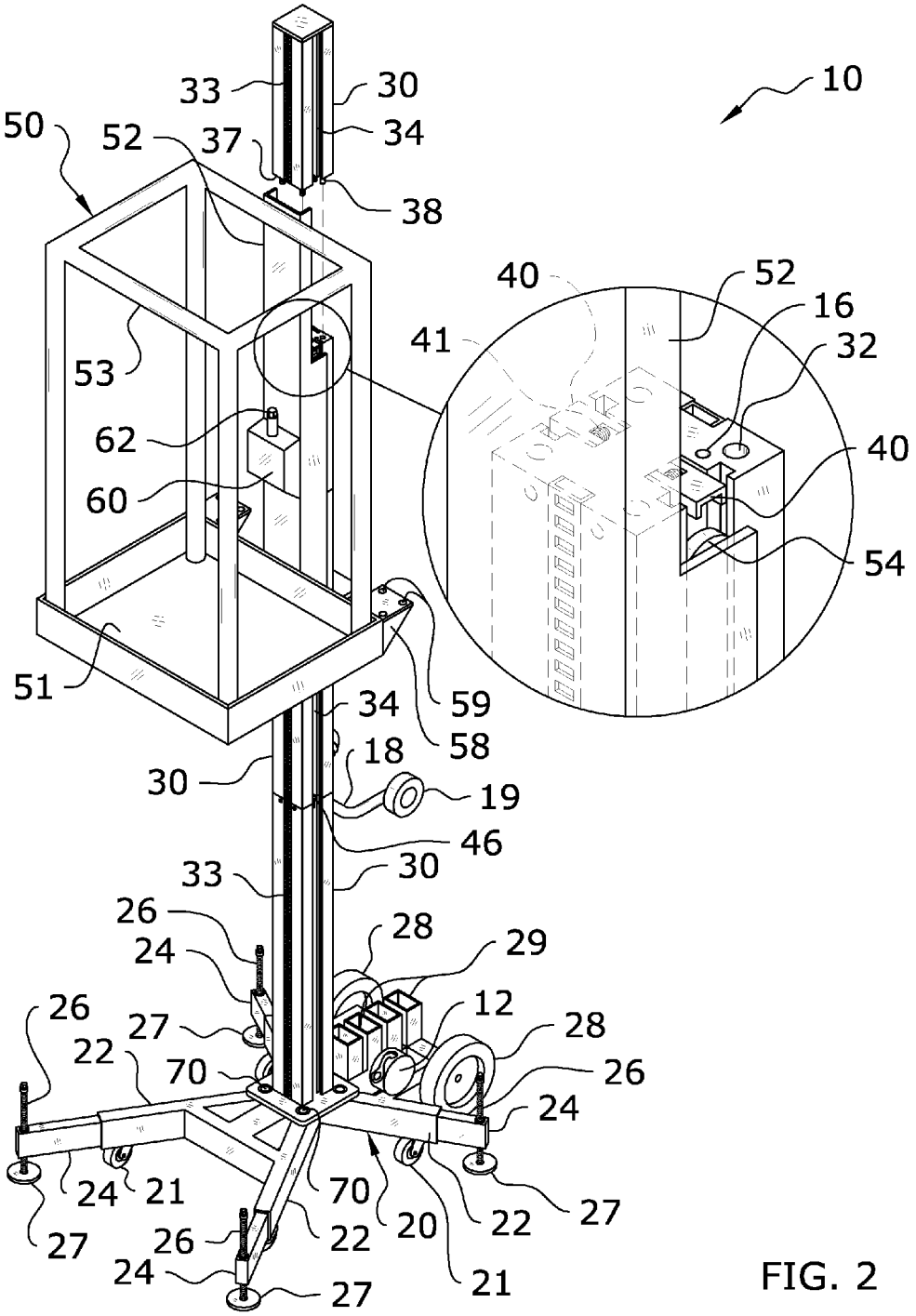
FIG. 2 is an upper perspective view of the present invention being assembled.

FIGS. 1 and 2 best illustrate the support base 20 which is utilize to provide support and stability to the present invention when in use. The support base 20 is comprised of a portable structure that is preferably lightweight which allows for easy transportation by a single individual. The support base 20 may be comprised of various types of materials such as but not limited to aluminum, steel and the like.

Figure 3:
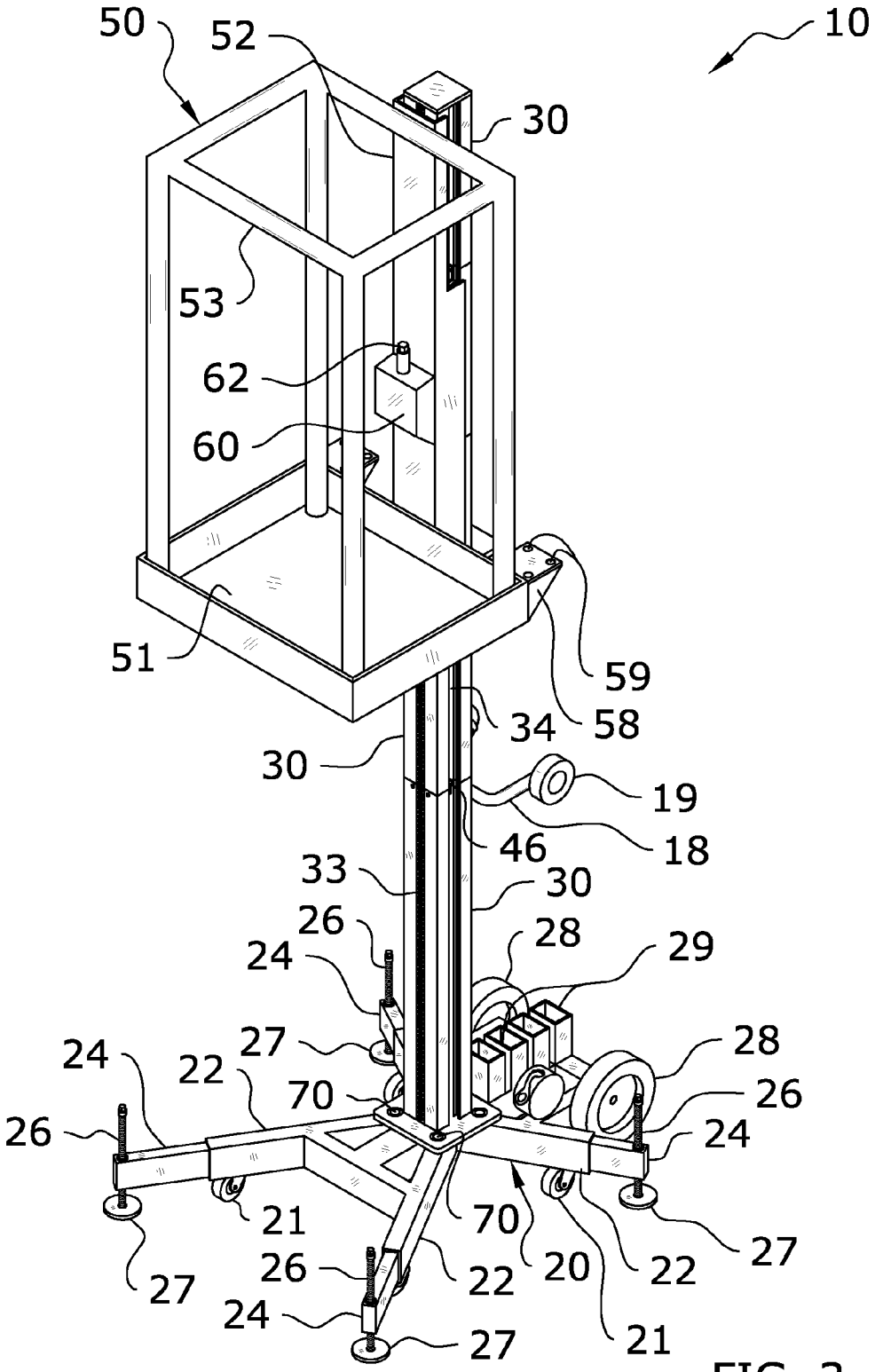
FIG. 3 is an upper perspective view of the present invention fully assembled.
Figure 4A:
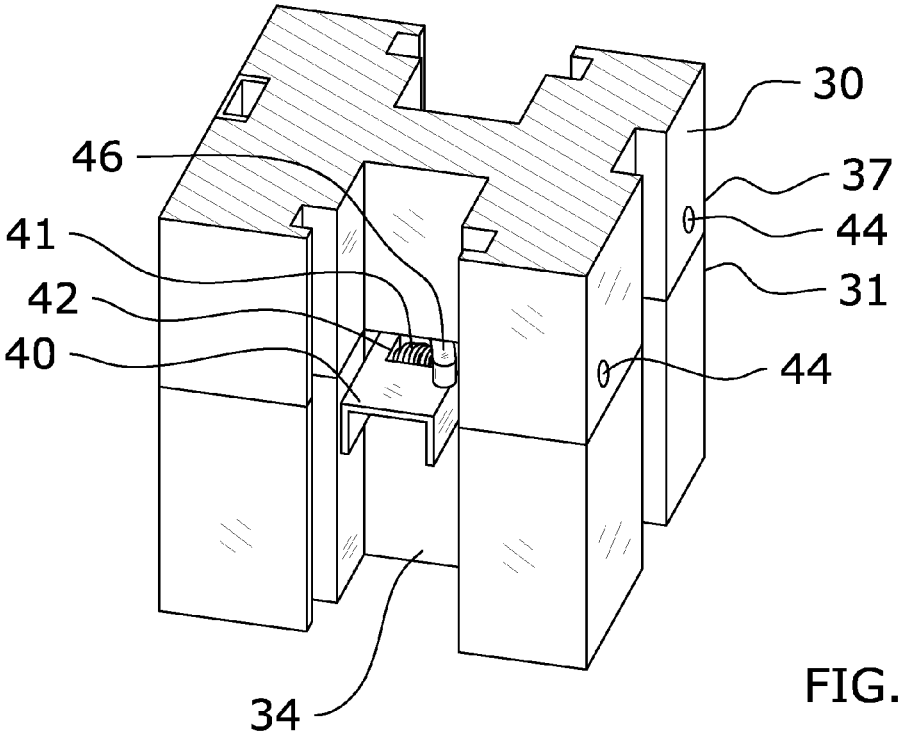
FIG. 4*a* is a magnified upper perspective view illustrating two mast sections being initially positioned together in an unlocked state with the securing lever in the released position and with the locking lever in the locked state to prevent movement of the securing levers.
Figure 4B:
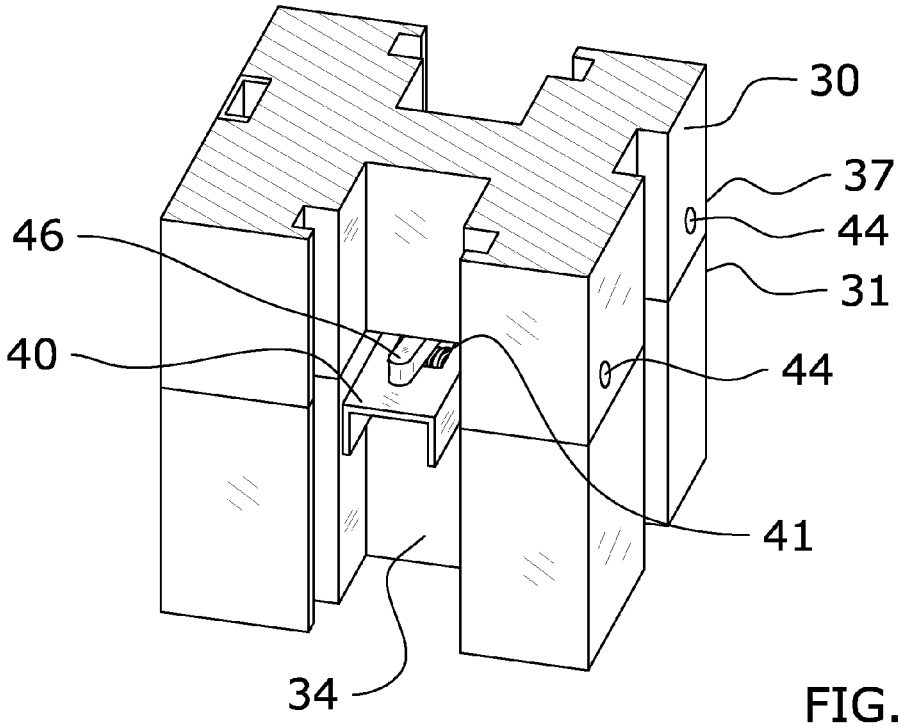
FIG. 4*b* is a magnified upper perspective view illustrating the two mast sections with the locking lever moved to a release state to allow for movement of the securing levers.
Figure 4C:
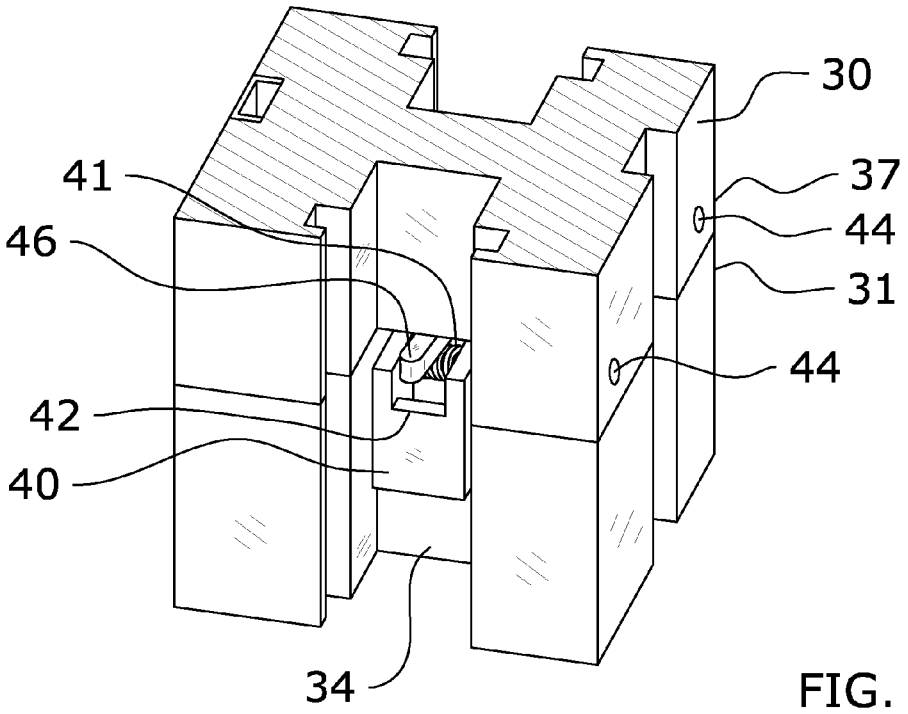
FIG. 4*c* is a magnified upper perspective view illustrating the securing lever positioned in the locked position to lock the locking pins within the receiver apertures by the locking shaft.
Figure 4D:
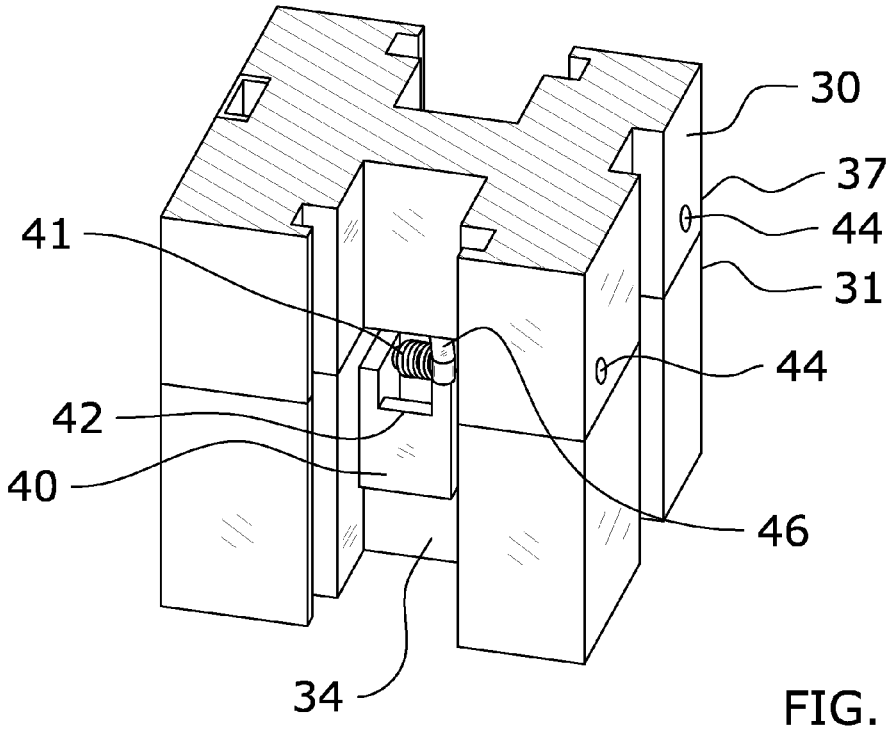
FIG. 4*d* is a magnified upper perspective view illustrating the securing lever positioned in the locked position and the locking lever in the locked state to prevent movement of the securing levers.

The support base 20 includes a plurality of legs that extend outwardly along a horizontal plane. The legs may extend outwardly in various patterns such as but not limited to an X-shaped pattern. There are preferably at least two front set of legs and two rear set of legs as illustrated in FIGS. 2 and 3 of the drawings. The legs may be comprised of a stationary leg structure, pivoting leg structure, telescoping leg structure or a removable leg structure. It is preferable that the legs have a compact state for storage and transportation as shown in FIG. 1 of the drawings, and an extended state for providing stability during use of the present invention as shown in FIGS. 2 and 3 of the drawings.

FIGS. 1 through 3 illustrate a removable leg structure wherein the legs are comprised of a plurality of inner legs 22 and a plurality of corresponding outer legs 24 that are received within the interior of the inner legs 22. The outer legs 24 are removed when the present invention is in the compact state and stored within the storage receivers 29 attached to the support base 20 as illustrated in FIG. 1 of the drawings. The storage receivers 29 are comprised of vertically orientated tubular receivers that receive an inner end of the outer legs 24 for storage as shown in FIG. 1.

The support base 20 preferably has a width of 30 inches or less when the plurality of legs are in the compact state to allow for passage through doorways and other narrow areas. The support base 20 preferably has a width of 53 inches or more when the plurality of legs are in the extended state to provide stability to the present invention when in use.

The support base 20 preferably includes a plurality of wheels to assist in the transportation of the present invention from one location to another. As illustrated in FIGS. 1 and 2 of the drawings, the plurality of wheels preferably include of a pair of base wheels 28 attached to a rear portion of the support base 20 that provide for transportation between various locations and upon various types of terrain (e.g. stairs, grass). as illustrated in FIGS. 1 and 2 of the drawings. A handle 18 having a U-shaped structure with opposing upper wheels 19 is preferably attached to the base mast as shown in FIG. 1 to provide additional support for the present invention when loading horizontally on to a flat surface such as a vehicle (e.g. pickup, truck).

The plurality of wheels further preferably includes a plurality of caster wheels 21 that allow for horizontal movement of the present invention upon a flat surface. The base wheels 28 are larger than the caster wheels 21 to provide for increased mobility over uneven terrain. The base wheels 28 may be constructed of a non-pneumatic tire structure (e.g. flat free tire) or a pneumatic tire structure. The base wheels 28 are preferably sufficient in size to allow for transport of the present invention up and down stairs. The bottom ends of the base wheels 28 are preferably higher than the lower end of the caster wheels 21 so that only the caster wheels 21 are supporting the present invention when in a substantially horizontal state and only the base wheels 28 support the present invention when inclined rearwardly. The caster wheels 21 are connected to the distal portions of the inner legs 22 to provide for maximum stability during movement when in the compact storage position as illustrated in FIG. 1 of the drawings.

The outer legs 24 each include an adjustment member 26 as illustrated in FIGS. 2, 3, 10 and 11 of the drawings. Each adjustment member 26 is preferably comprised of a threaded shaft that includes a coupler at the upper end thereof for allowing a wrench or drill to connect to for rotation thereof. Each adjustment member 26 includes a pad 27 at the lower end thereof that engages a ground surface supporting the present invention. The pad 27 is preferably comprised of a broad structure to prevent damage to the surface and to provide increased stability.

Figure 11:
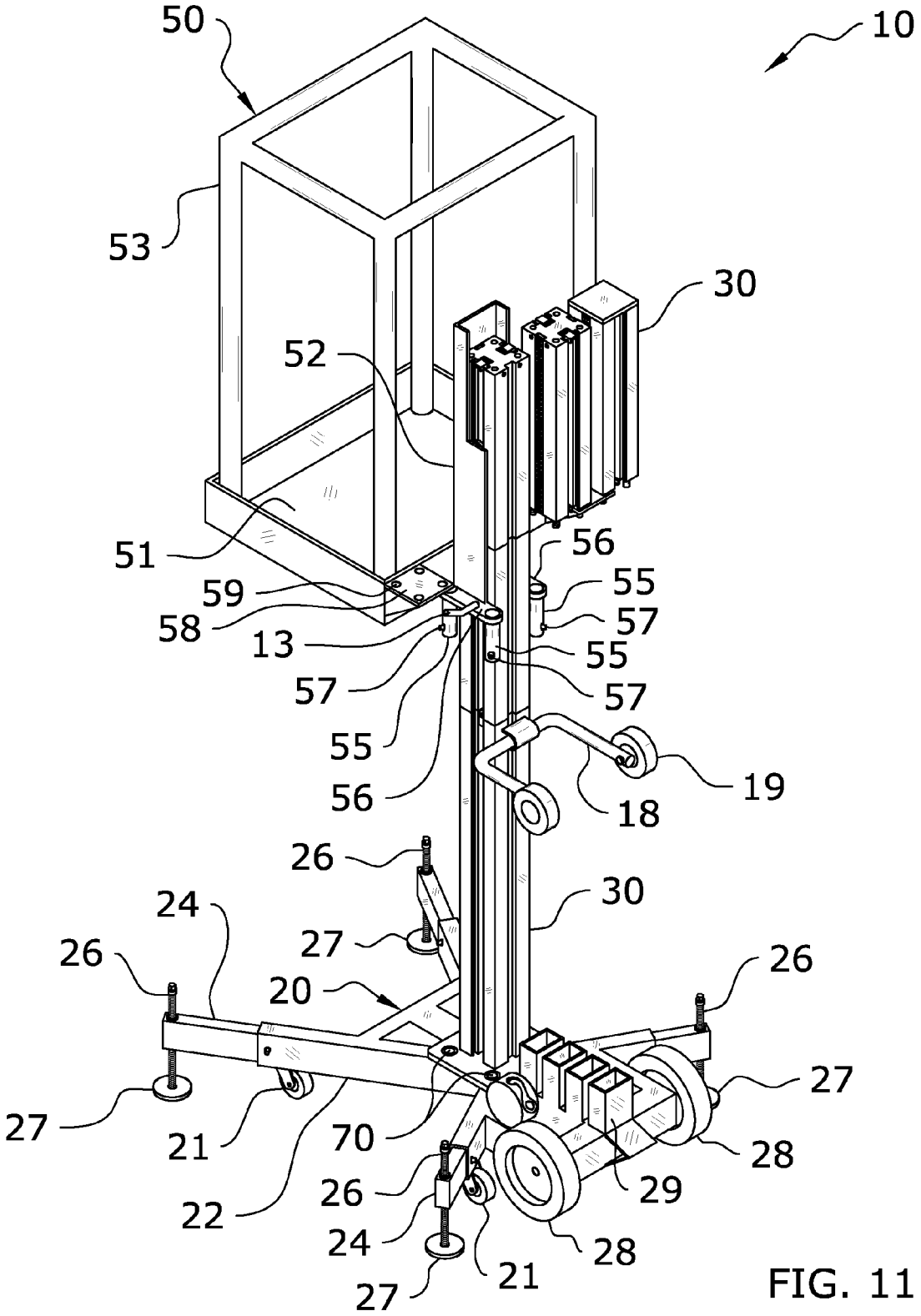
FIG. 11 is an upper perspective view of the support platform elevated above the support base.

The outer legs 24 are secured within the inner legs 22 by a detent structure or fastener. Each of the inner legs 22 include a guide member 70 having an upper tapered opening that receives a corresponding finger member 55 extending downwardly from the support platform 50. The finger members 55 are preferably attached to a pair of extended members 56 that extend from the support platform 50 as illustrated in FIG. 11 of the drawings. The finger members 55 extend downwardly and are aligned with the openings within the guide members 70 so when the support platform 50 is fully lowered, the finger members 55 are positioned within the guide members 70 and when the support platform 50 is elevated slightly the finger members 55 are outside of the guide members 70.

Each inner leg 22 includes a lower biased unit 72 that is positioned within a lower interior portion of the inner leg 22 below each of the guide members 70 to allow for selective engagement of the upper end of the lower biased unit 72 with the lower end of the finger members 55. A flanged end member 74 extends horizontally from the lower biased unit 72 and extends through a slot 25 within a partition member 23 within the outer leg 24.

Figure 12:
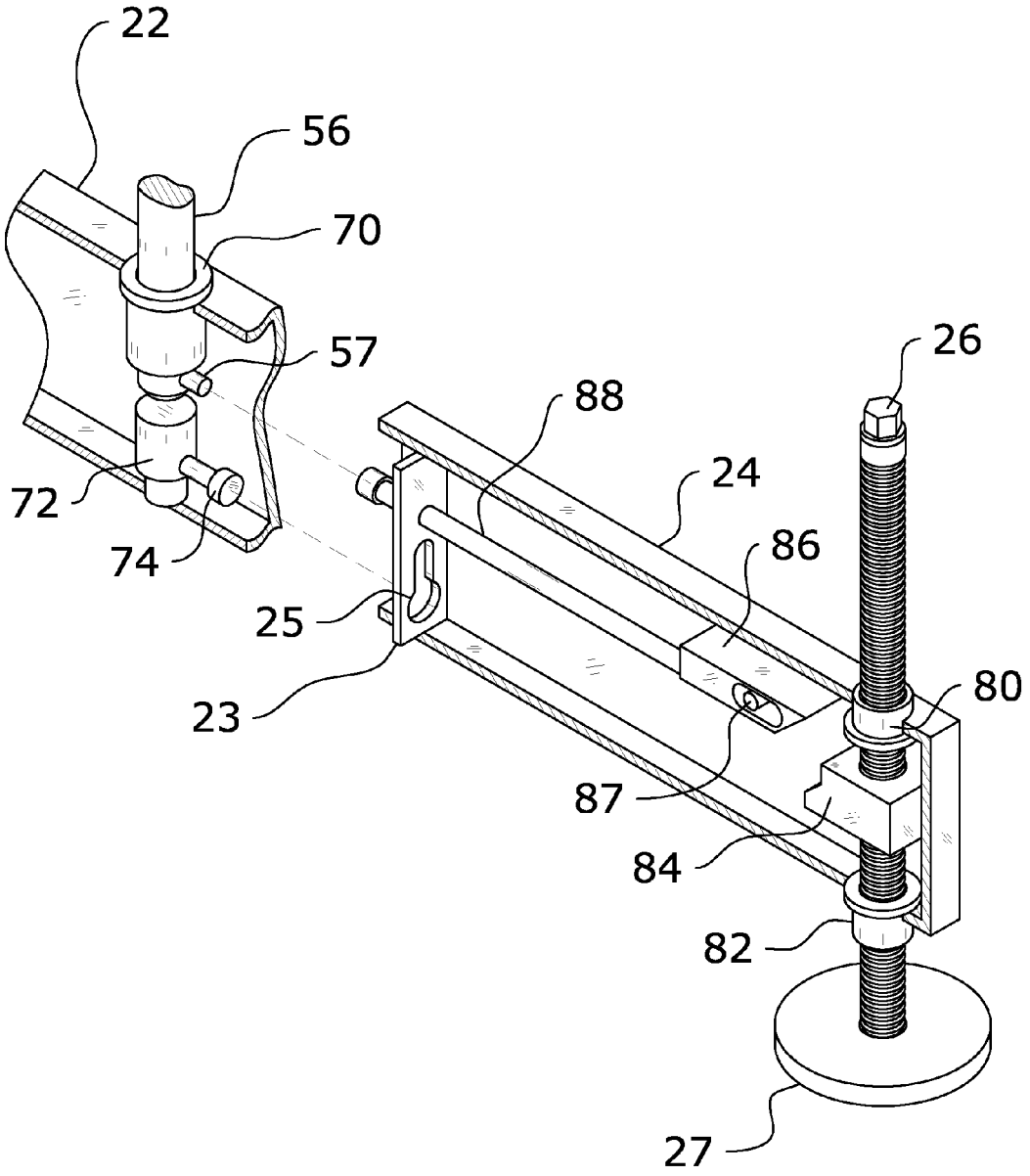
FIG. 12 is an upper perspective cutaway view of the inner leg and outer leg.

Each outer leg 24 preferably includes an upper bushing 80 and a lower bushing 82 as illustrated in FIG. 12 of the drawings. The upper bushing 80 and the lower bushing 82 each preferably have an interior flange that is larger than the aperture within the outer leg 24 positioned within. A first engaging member 84 is threadably attached to each adjustment member 26 between the upper bushing 80 and the lower bushing 82. The first engaging member 84 has a width that is slightly less than the interior width of the outer leg 24 thereby preventing rotation of the first engaging member 84 when the adjustment member 26 is rotated. The first engaging member 84 has a tapered end that selectively engages a corresponding tapered end of a second engaging member 86 as shown in FIG. 12. The second engaging member 86 is positioned upon an alignment pin 87 and is biased towards the first engaging member 84 with a biasing device (e.g. spring). An elongated shaft 88 is attached to the second engaging member 86 and passes through an aperture within the partition member 23 and selectively engages a locking detent 57 within the corresponding finger member 55 as shown in FIGS. 12 through 13*c* of the drawings.

Figure 13A:
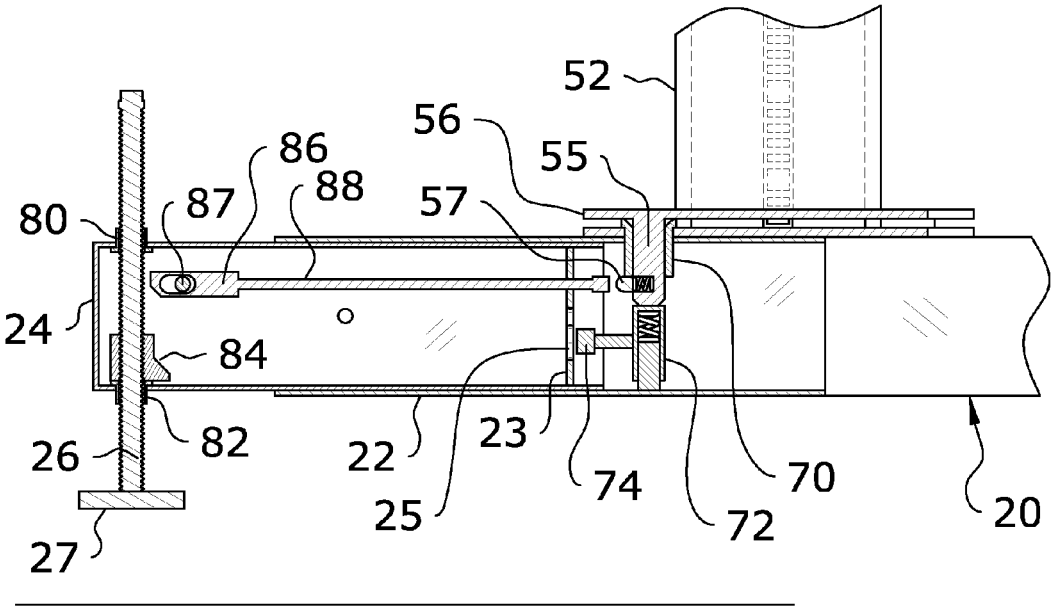
FIG. 13*a* is a side cutaway view of the outer leg with no weight supported by the corresponding adjustment member.
Figure 13B:
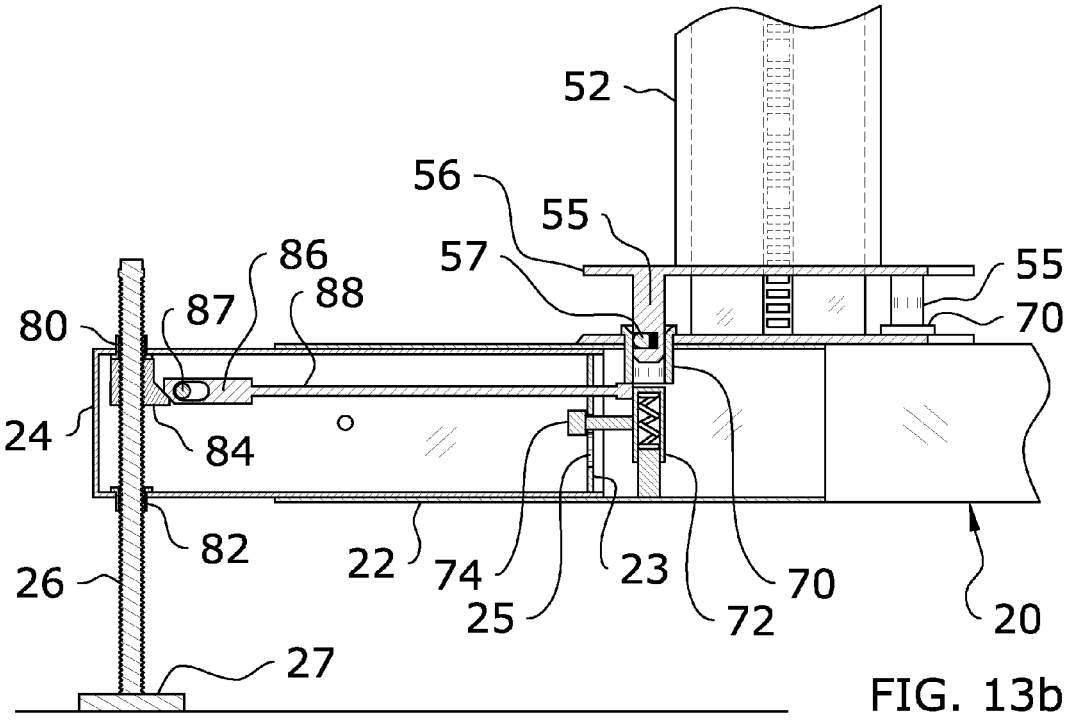
FIG. 13*b* is a side cutaway view of the outer leg with weight supported by the corresponding adjustment member thereby releasing the locking detent and the corresponding finger member.
Figure 13C:
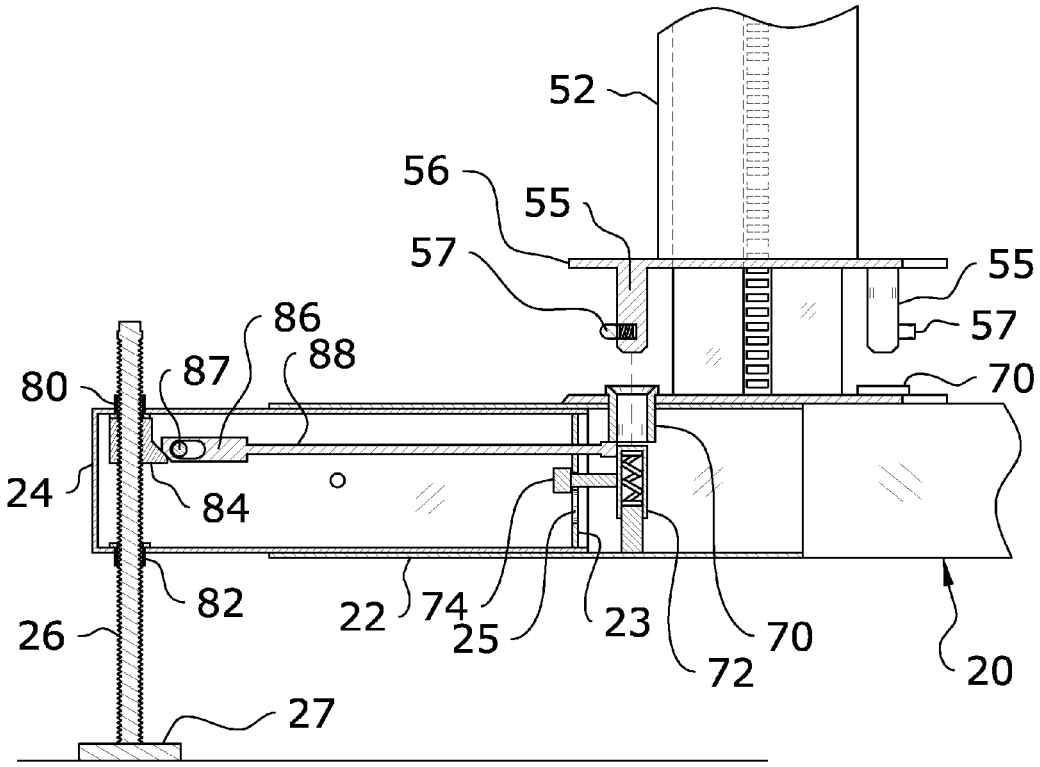
FIG. 13*c* is a side cutaway view of the outer leg with weight supported by the corresponding adjustment member and with the corresponding finger member removed from the corresponding guide member.

When the pad 27 is not bearing any weight, the first engaging member 86 is adjacent to and touching the lower bushing 82 as illustrated in FIG. 13*a*. When the pad 27 engages the ground surface and is bearing weight, the first engaging member 84 is elevated within the outer leg 24 to engage the upper bushing 80 and also engaging the second engaging member 86 as illustrated in FIGS. 13*b* and 13*c* of the drawings.

C. Vertical Mast.

It is preferable to have a single vertical mast constructed from the plurality of interconnected mast sections 30 as illustrated in FIGS. 2 and 3 of the drawings. However, more than one vertical mast may be constructed utilizing the present invention in situations that require more than one vertical mast to increased strength and stability. The vertical mast includes a track 33 extending up the length of the vertical mast that the drive unit 60 engages (e.g. with a sprocket or gear) to elevate and lower the support platform 50 with respect to the vertical mast. The vertical mast further includes a pair of opposing side channels 34 that receive the guide wheels 54 of the support platform 50.

The vertical mast extends upwardly from the support base 20 as illustrated in FIGS. 2 and 3 of the drawings. The vertical mast is comprised of a plurality of mast sections 30 removably connected to one another to form the vertical mast that extends upwardly from the support base 20. The vertical mast may be constructed of various numbers of mast sections 30 (e.g. 2, 3, 4, 5, etc.) and each of the mast sections 30 may be comprised of the same or different lengths (e.g. 2 feet, 4 feet, 6 feet).

While not required, it is preferable to have a base mast that is permanently or semi-permanently attached to the support base 20 as illustrated in FIG. 1 of the drawings. The permanent attachment of the base mast increases stability and provides a partial assembly of the present invention. The base mast may also have the same length or be longer than the other mast sections 30. The upper end of the base mast includes a coupler that is capable of receiving the next mast section 30 similar to the ends of the mast sections 30 as discussed further herein. Alternatively, one of the plurality of mast sections 30 may be removably attached to the support base 20 instead of having a base mast.

The plurality of mast sections 30 each have a first end 31 and a second end 37. The first end 31 may be comprised of the upper end or the lower end of the respective mast section 30. The second end 37 of the respective mast section 30 is opposite of the first end 31 and may be comprised of the upper end or the lower end of the respective mast section 30. The first end 31 and the second end 37 of the mast sections 30 are preferably parallel with respect to one another.

The first end 31 of each mast section 30 includes a first coupler and the second end 37 of each mast section 30 includes a second coupler. The first coupler is removably connectable to the second coupler to removably connect the plurality of mast sections 30 in a vertical and aligned manner. The first coupler and the second coupler allow for secure and relatively non-moving attachment of the mast sections 30 with respect to one another.

As shown in FIGS. 8*a* through 8*d* of the drawings, a sequencing aperture 16 is preferably positioned within the first end 31 of the mast section 30 that corresponds to a sequencing pin 14 extending from a second end 37 of a mast section 30 designed to be positioned above the initial mast section 30. To ensure that the proper combination of mast sections 30 are assembled in the proper order, alignment and to limit the height of the assembled vertical mast (i.e. with the track 33 aligned for each of the mast sections 30 the sequencing aperture 16 could be positioned within the opposite side of the track 33), the sequencing aperture 16 for each of the mast sections 30 is different and the sequencing pin 14 for each of the mast sections 30 is different. FIGS. 8*a* through 8*d* illustrate utilizing a steadily moving set of sequencing apertures 16 and sequencing pins 14. The upper most mast section 30 would not have a sequencing pin 14 or sequencing aperture 16 at the upper end thereof. The upper most mast section 30 preferably does not have any sequencing aperture 16 or receiver apertures 32.

Each of the plurality of mast sections 30 preferably has a rectangular cross section (e.g. square shaped) and are comprised of extruded aluminum to provide for a cost-effective, lightweight structure capable of supporting the support platform 50 along with cargo. It can be appreciated that the mast sections 30 may be comprised of various other cross sections (e.g. circular, hexagonal, triangular, etc.) The first end 31 and the second end 37 of each of the mast sections 30 is preferably flat and transverse with respect to the longitudinal axis of the respective mast sections 30 to maximize the physical contact between the first end 31 of a first mast section 30 and a second end 37 of an adjacent mast section 30. Each of the mast sections 30 includes a track 33 on one side thereof that the drive unit 60 engages. The track 33 for each of the mast sections 30 is aligned when assembled into the vertical mast. Each of the mast sections 30 also includes the opposing pair of side channels 34. The side channels 34 for each of the mast sections 30 are aligned when assembled into the vertical mast thereby creating a single elongated pair of side channels 34 within the vertical mast allowing free passage of the guide wheels 54.

The first coupler and the second coupler are each preferably comprised of a plurality of receiver apertures 32 or a plurality of locking pins 38 that are received within the receiver apertures 32. If the first coupler is comprised of the receiver apertures 32 then the second coupler is comprised of the locking pins 38 to allow for interconnection of two or more mast sections 30. The first coupler is aligned with the second coupler for each of the mast sections 30 to allow for interconnection of each of the mast sections 30.

Figure 9A:
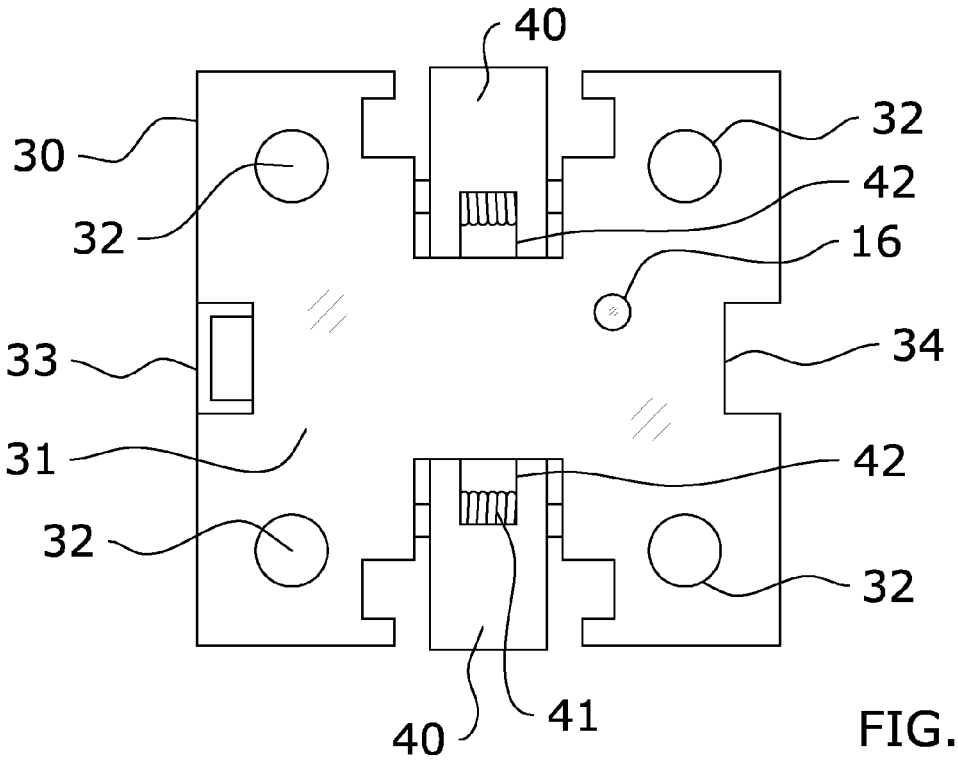
FIG. 9*a* is a top end view of a mast section illustrating the sequencing aperture.

FIGS. 8*a* through 8*d* illustrate the receiver apertures 32 within the first end 31 (the first end 31 is shown as the upper end in the figures whereas the first end 31 could be the lower end alternatively). The receiver apertures 32 are formed to have an upper tapered portion to help guide the locking pins 38 into the receiver apertures 32 with the middle to lower portions of the receiver apertures 32 formed to snugly receive the locking pins 38 with limited movement to ensure a stable vertical mast when constructed. The plurality of receiver apertures 32 are preferably comprised of four corner receiver apertures 32 positioned adjacent to each corner of the first end 31 of the mast section 30 as illustrated in FIG. 9*a* of the drawings.

The plurality of receiver apertures 32 removably receive the plurality of locking pins 38 in a catchable manner. The locking pins 38 have a length sufficient to ensure secure reception within the receiver apertures 32 (e.g. at least one inch). The locking pins 38 are also preferably comprised of four corner locking pins 38 positioned adjacent to each corner of the second end 37 of the mast section 30 The plurality of locking pins 38 each include a locking channel 39 that extends through a side portion of the locking pins 38 transverse with respect to the longitudinal axis of the locking pins 38. The locking channel 39 allows the locking shaft 44 to pass through and selectively prevent the locking pins 38 from exiting the receiver apertures 32. The plurality of locking pins 38 extend parallel with respect to a longitudinal axis of the plurality of mast sections 30.

Figure 5A:
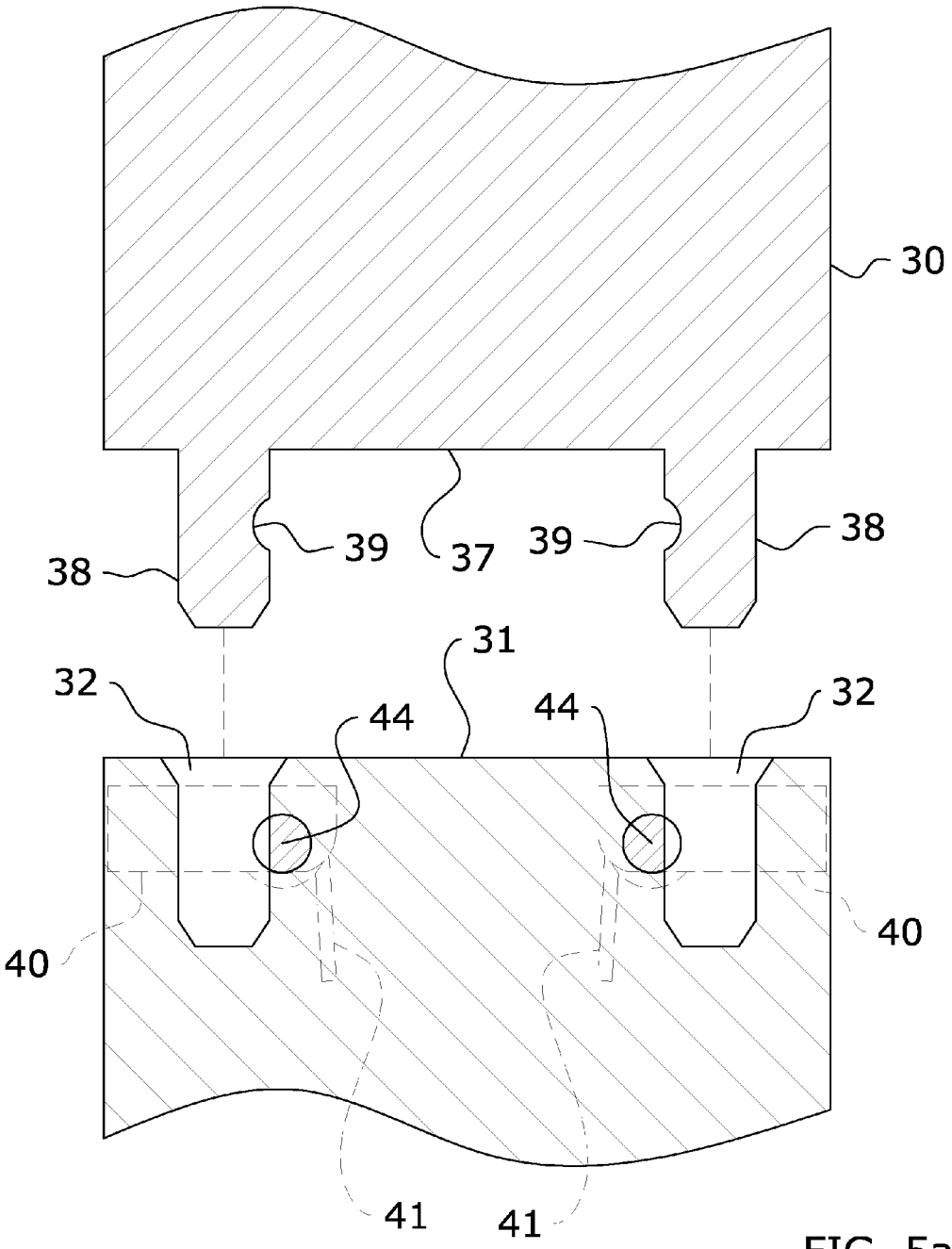
FIG. 5*a* is a side cutaway view of a first mast section positioned above a second mast section prior to connection thereof
Figure 5B:
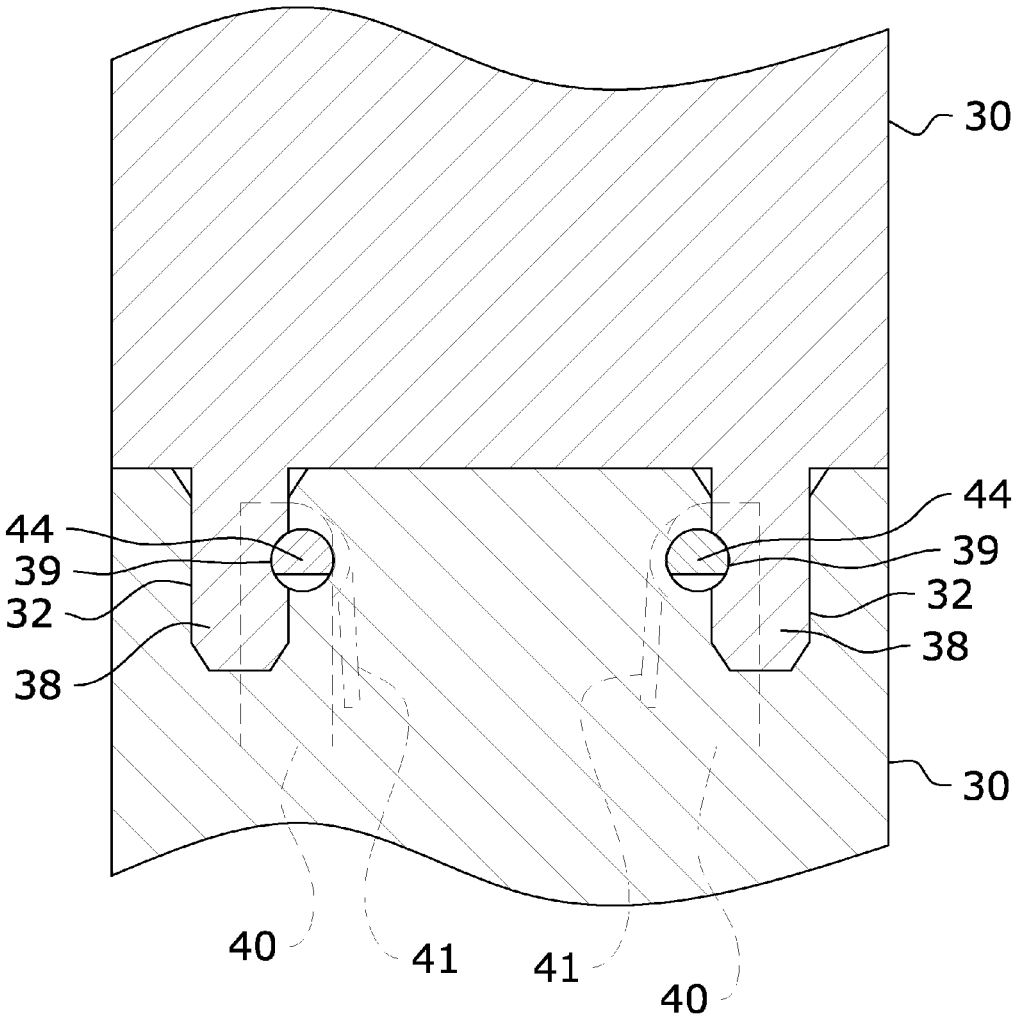
FIG. 5*b* is a side cutaway view of the first mast section connected to the second mast section with the locking shaft rotated to lock the locking pins.
Figure 6A:
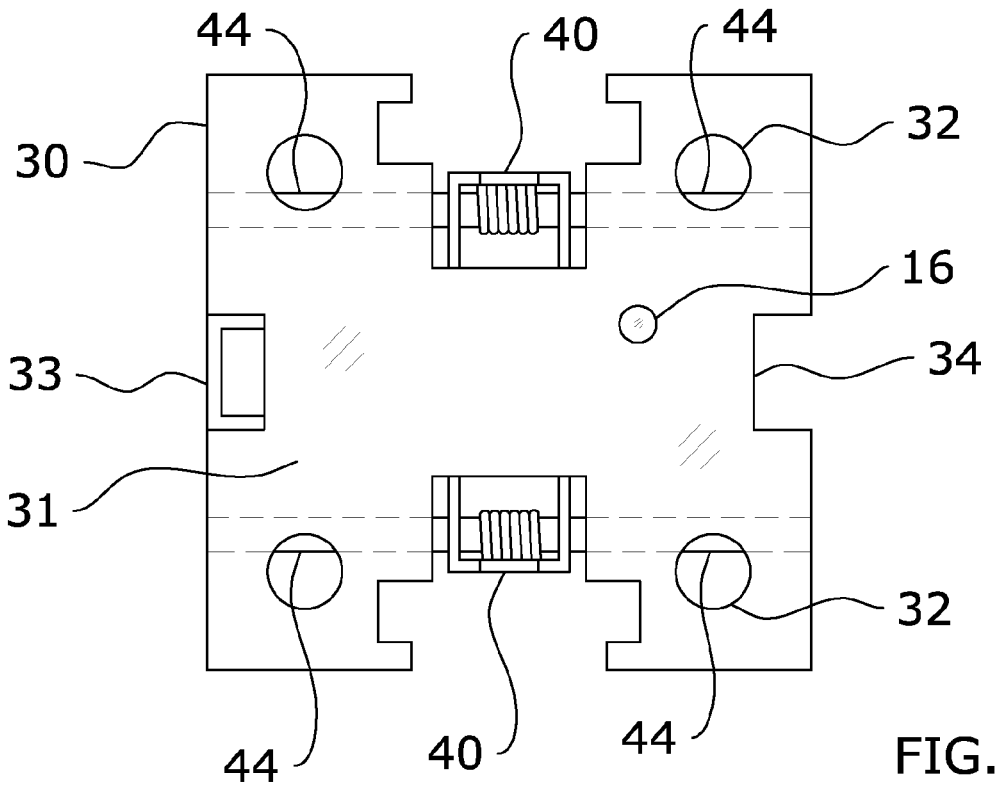
FIG. 6*a* is a bottom end view of a mast section showing the locking lever in the locked state to prevent movement of the securing levers.
Figure 6B:
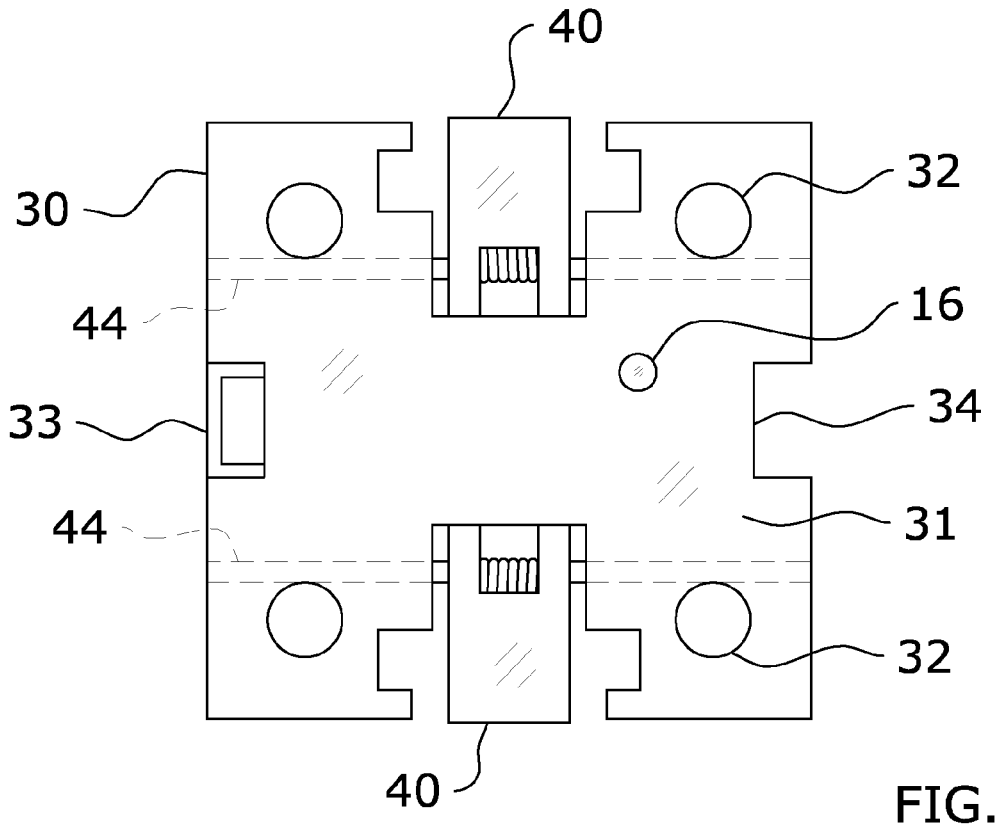
FIG. 6*b* is a bottom end view of a mast section showing the locking lever in the release state to prevent movement of the securing levers.

One or more locking shafts 44 are rotatably positioned within each of the plurality of mast sections 30 and partially extend into at least two of the plurality of receiver apertures 32 to selectively engage the locking pins 38. As shown in FIGS. 5*a* and 5*b* of the drawings, two locking shafts 44 are preferably utilized to selectively secure opposing pairs of locking pins 38. The locking shaft 44 is comprised of a cam shaped structure that allows for selective release and locking of the plurality of locking pins 38 with respect to the plurality of locking pins 38. As illustrated in FIGS. 5*a* and 5*b* of the drawings, the cam shaped structure of the locking shaft 44 is preferably comprised of a generally circular cross sectional shape with a side portion cutaway forming a cutaway that allows the locking pins 38 to pass by as illustrated in FIG. 5*a* of the drawings. When the locking shaft 44 is rotated the thicker body portion is rotated into the receiver openings and into the respective locking channel 39 of the locking pins 38 thereby preventing removal of the locking pins 38. As illustrated in FIG. 5*a* of the drawings, the locking channel 39 preferably has a curved configuration that corresponds to the diameter of the locking shaft 44 to ensure a snug fit when the locking shaft 44 is rotated into the lock position as shown in FIG. 5*b* of the drawings.

Figure 7A:
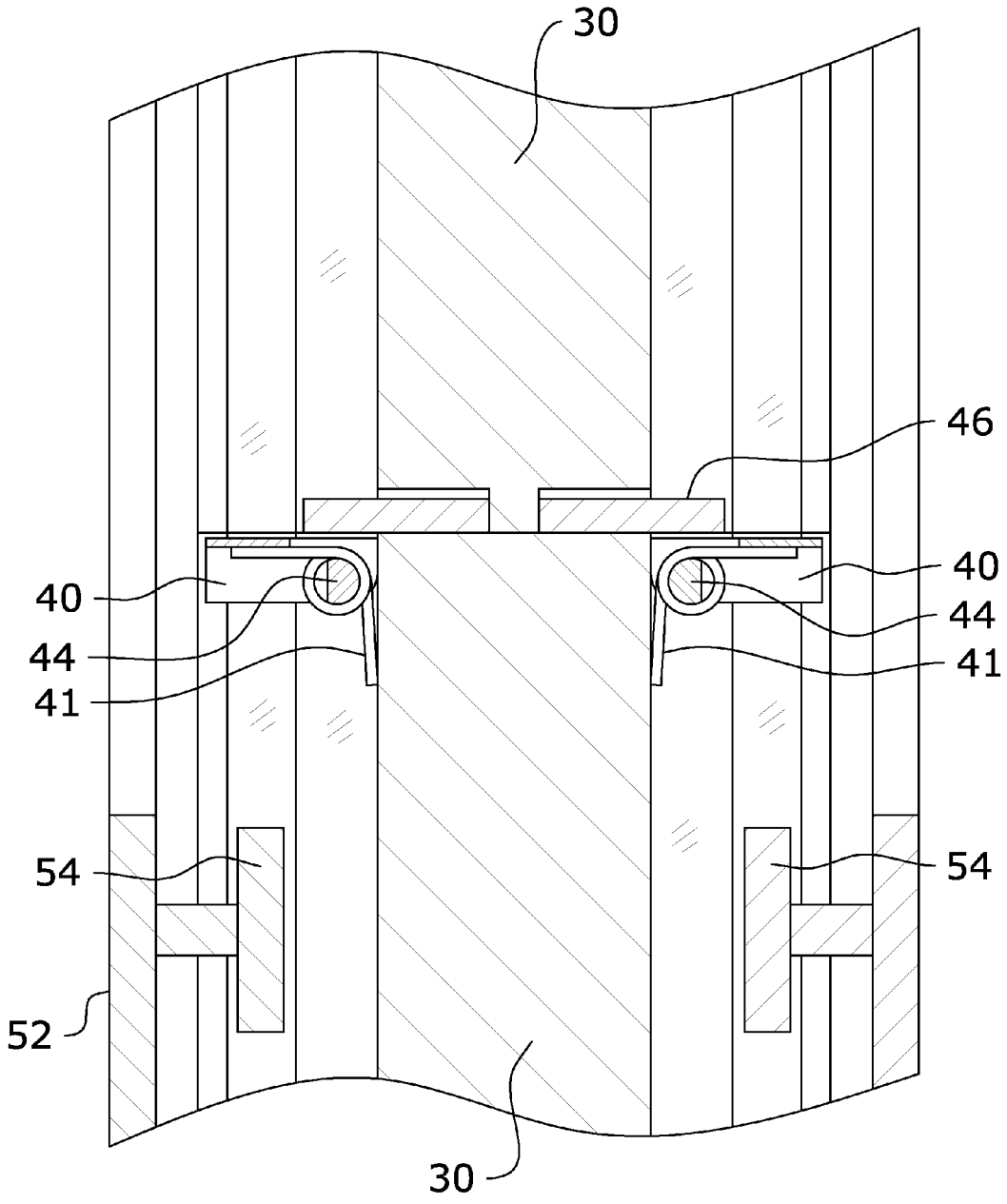
FIG. 7*a* is a side cutaway view showing the securing levers in the released position extending outwardly thereby preventing passage of the guide wheels upwardly onto the next mast section.
Figure 7B:
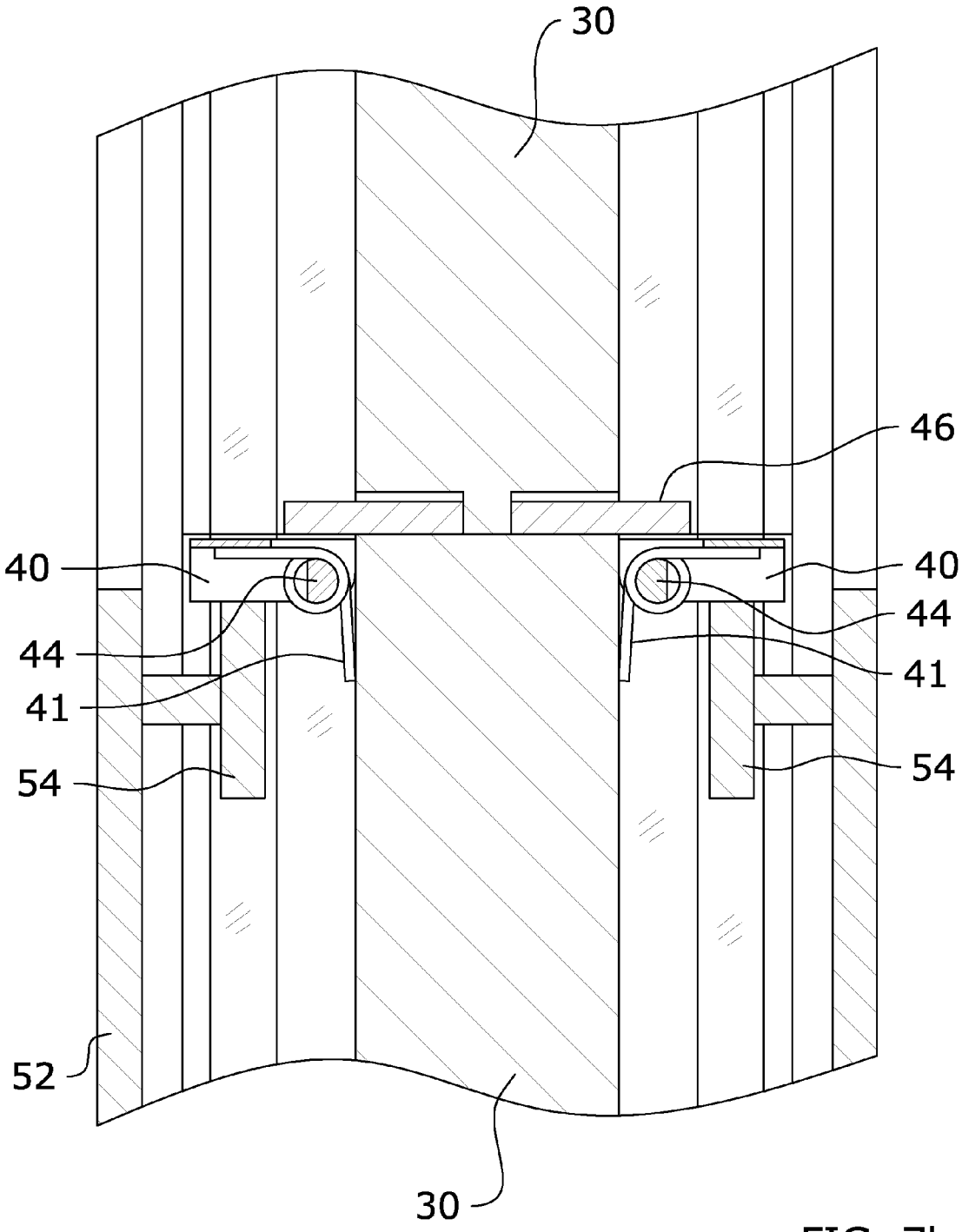
FIG. 7*b* is a side cutaway view showing the securing levers in the released position extending outwardly with the guide wheels engaging the extended securing levers thereby preventing passage of the guide wheels upwardly onto the next mast section.
Figure 7C:
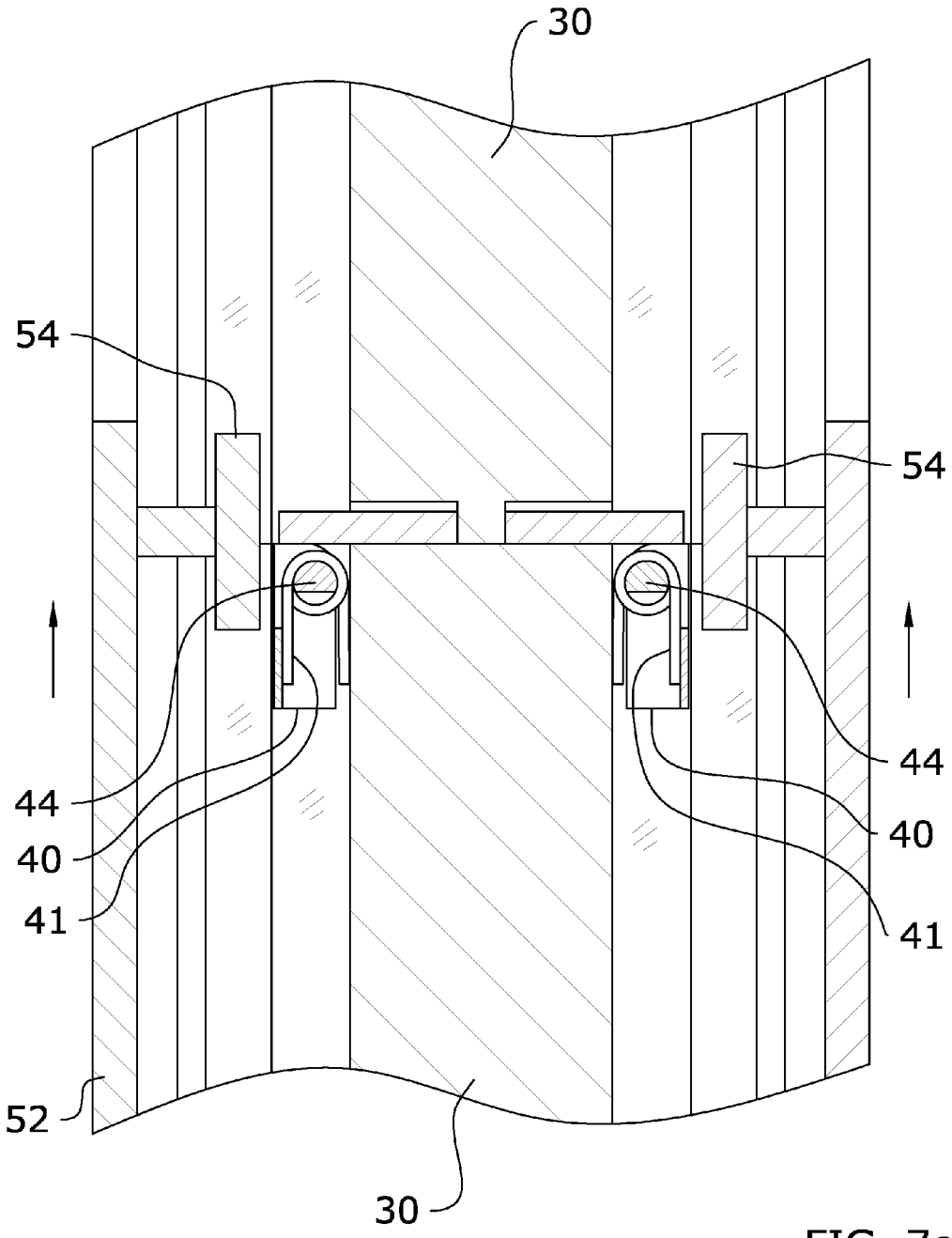
FIG. 7*c* is a side cutaway view showing the securing levers in the locked position thereby allowing passage of the guide wheels upwardly onto the next mast section.
Figure 8A:
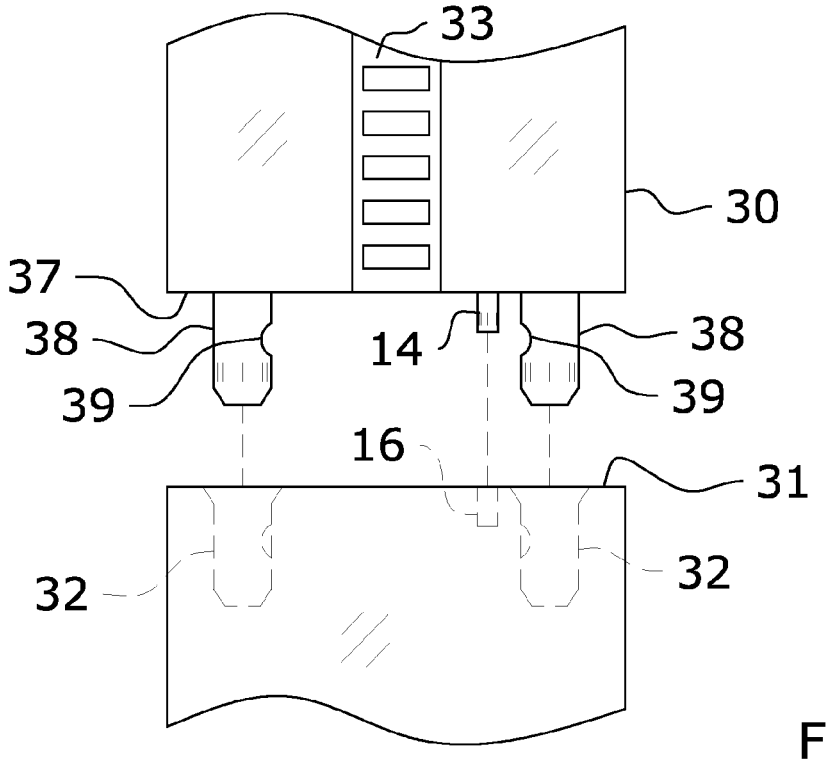
FIG. 8*a* is a side view of an upper mast section positioned above a lower mast section with a sequencing pin extending from the lower end in a first position of the upper mast section and aligned with a sequencing aperture extending within the upper end of the lower mast section in a first position corresponding to the sequencing pin.
Figure 8B:
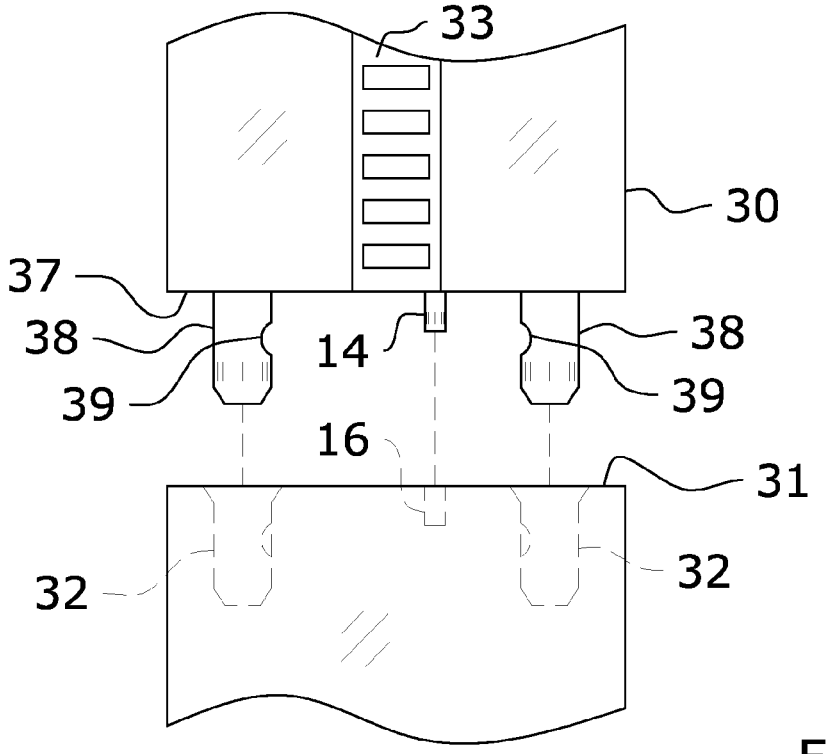
FIG. 8*b* is a side view of an upper mast section positioned above a lower mast section with a sequencing pin extending from the lower end in a second position of the upper mast section and aligned with a sequencing aperture extending within the upper end of the lower mast section in a second position corresponding to the sequencing pin.
Figure 8C:
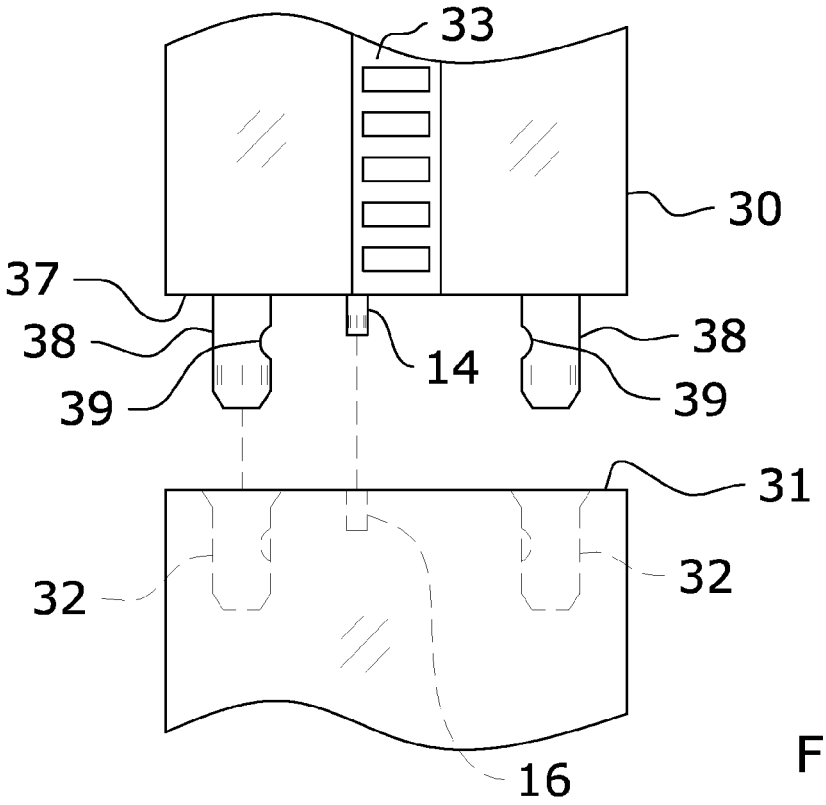
FIG. 8*c* is a side view of an upper mast section positioned above a lower mast section with a sequencing pin extending from the lower end in a third position of the upper mast section and aligned with a sequencing aperture extending within the upper end of the lower mast section in a third position corresponding to the sequencing pin.
Figure 8D:
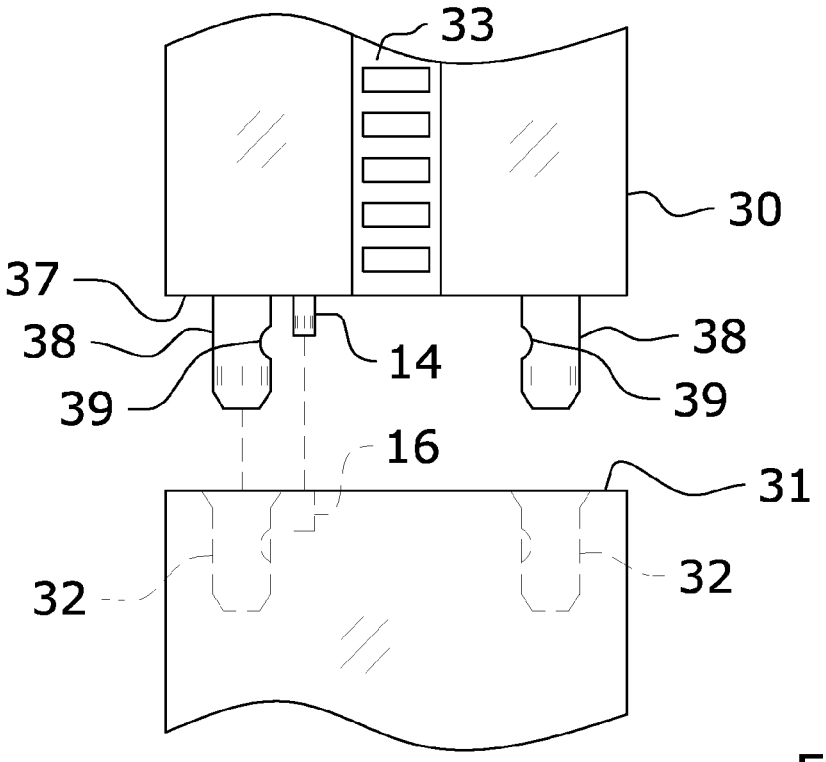
FIG. 8*d* is a side view of an upper mast section positioned above a lower mast section with a sequencing pin extending from the lower end in a fourth position of the upper mast section and aligned with a sequencing aperture extending within the upper end of the lower mast section in a fourth position corresponding to the sequencing pin.

A securing lever 40 is connected to the locking shaft 44 to allow for manual rotation of the locking shaft 44. Each locking shaft 44 includes a securing lever 40, so as illustrated in the FIGS. 7*a* through 7*c* of the drawings, it is preferably to have two opposing securing levers 40 attached near the first end 31 of each respective mast section 30. The securing lever 40 has a locked position preventing release of the plurality of locking pins 38 from the receiver apertures 32 and a release position allowing release of the plurality of locking pins 38 from the receiver apertures 32. Each of the securing levers 40 is preferably positioned within one of the side channels 34 within the vertical mast to allow for stoppage of the guide wheels 54 when the locking shaft 44 has not fully secure the locking pins 38 or passage of the guide wheels 54 when the locking shaft 44 has fully secured the locking pins 38. Each of the securing levers 40 preferably includes a biased member 41 (e.g. spring) that forces the securing levers 40 outwardly into the release position as shown in FIG. 7*a* of the drawings. When the securing lever 40 is positioned within the release position as shown in FIGS. 7*a* and 7*b* of the drawings, the support platform 50 is prevented from being elevated to an upper mast section 30 above a lower mast section 30.

Figure 9B:
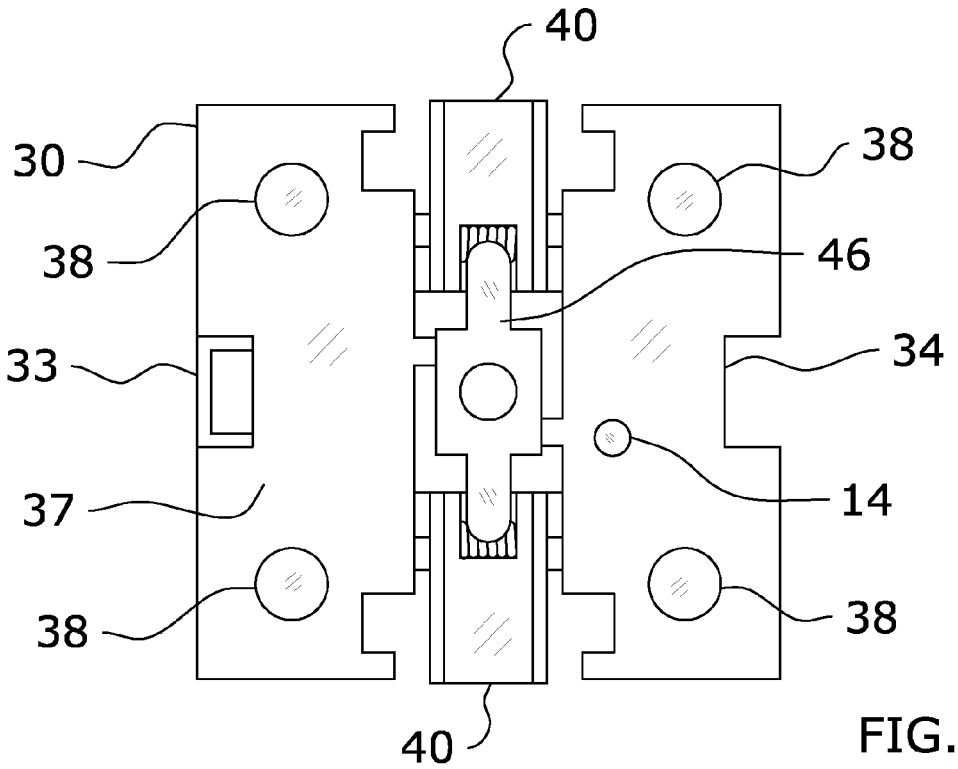
FIG. 9*b* is a bottom end view of the mast section illustrating the sequencing pin.

A locking lever 46 is rotatably attached to the second end 37 of a mast section 30 above a lower mast section 30 as illustrated in FIG. 9*b* of the drawings. The locking lever 46 is rotatably biased by a spring or other device to be positioned in a locked position and the locking lever 46 is positioned adjacent to the securing levers 40 to prevent movement of the securing levers 40 when in the locked state. The locking lever 46 preferably extends from both sides of the mast section 30 to allow for selective engagement with the securing levers 40 with a single movement. The securing levers 40 each include a centrally located notch 42 that when the locking lever 46 is aligned with (as shown in FIG. 9*b* of the drawings) the locking lever 46 is allowed to be pivoted into the locked position thereby rotating the locking shaft 44 to the locked position to prevent the locking pins 38 from being released from the receiver apertures 32.

D. Support Platform.

The support platform 50 is adapted to be movably connected to the vertical mast. FIGS. 1 through 3 illustrate an exemplary support platform 50 having a floor 51 and a cage 53. It can be appreciated that various other configurations may be utilized for the support platform 50 that are capable of lifting and lowering workers and materials. The width of the support platform 50 is the same or less than the width of the support base 20 when in the compact state to allow for passage through narrow areas. It is preferable that the width of the support platform 50 be 30 inches or less. The support platform 50 is constructed of a lightweight material such as but not limited to aluminum.

The support platform 50 includes a sliding support 52 extending from the support platform 50 that has a U-shaped structure that is positioned about three sides of the vertical mast. The sliding support 52 includes a plurality of guide wheels 54 that are movably received within the side channels 34 of the vertical mast to allow for relatively free upward and downward movement of the support platform 50 upon the vertical mast. It is preferable to have at least two guide wheels 54 for each of the side channels 34 within the vertical mast, with one of the guide wheels 54 positioned within an upper portion of the sliding support 52 and another of the guide wheels 54 positioned within a lower portion of the sliding support 52 to provide for increased stability and to prevent binding during operation. The diameter of the guide wheels 54 is slightly smaller than the width of the side channels 34 within the vertical mast to limit movement thereof.

A drive unit 60 is connected to the support platform 50 that is adapted to elevate and lower the support platform 50 upon the vertical mast. The drive unit 60 may include an actuator (e.g. electric motor, hydraulic motor) or a drive connector 62 to attach an outside actuator (e.g. a drill, hand crank). The drive unit 60 preferably includes an automatic braking system that prevents accidental lowering of the support platform 50 if the actuator should fail or is accidentally removed. The drive unit 60 mechanically engages the track 33 extending along a substantial portion of the length of the vertical mast utilizing a sprocket or other mechanical drive device. U.S. Pat. No. 6,981,573 to Nickel illustrates an exemplary drive unit 60 and is hereby incorporated by reference herein.

An emergency winch 12 is attached to the support base 20 that has a tether connectable to an emergency connector 13 attached to the support platform 50 to allow for an individual at the base of the present invention to lower the support platform 50 where the operator of the present invention is unable to. The emergency winch 12 draws the support platform 50 downwardly overcoming the braking force applied by the automatic breaking system within the drive unit 60 thereby forcing the support platform 50 to lower.

At least one mast storage device 58 extends outwardly from the support platform 50 as illustrated in FIGS. 1 through 3 of the drawings. The plurality of mast sections 30 are removably connectable to the mast storage devices 58 for storage of the plurality of mast sections 30 during non-use of the present invention, during assembly of the vertical mast and during disassembly of the vertical mast. The mast storage devices 58 are comprised of an extended bracket structure with an upper plate that includes a plurality of storage apertures 59 that receive the corresponding locking pins 38 from each mast section 30. As illustrated in FIG. 1 of the drawings, only two of the locking pins 38 from each mast section 30 are required to be inserted into the mast storage device 58 thereby allowing two or more mast sections 30 to be received and stored upon each of the mast storage devices 58. The mast storage devices 58 are preferably attached to the lower portion of the support platform 50 and extend outwardly on opposing sides of the vertical mast as illustrated in FIGS. 1 through 3 of the drawings.

E. Operation of Preferred Embodiment.

In use, the user transports the present invention in the compact storage position (FIG. 1) to a desired location where working at an elevated height is required (e.g. interior of a building). The user then removes the outer legs 24 and attaches them to the inner legs 22 of the support base 20.

The respective adjustment members 26 for each of the outer legs 24 are lowered by rotating the adjustment members 26 until the caster wheels 21 are no longer supporting the present invention.

The support platform 50 will not be allowed to move upwardly unless all of the finger members 55 are allowed to freely pass through and out of the guide members 70. Free movement of the finger members 55 within the guide members 70 requires an upward pressure to be applied to each of the adjustment members 26 causing the first engaging member 84 to inwardly push the second engaging member 86 thereby causing the elongated shaft 88 to depress the corresponding locking detent 57 sufficiently so that the locking detent 57 does not catch upon the lower end of the corresponding guide member 70 as illustrated in FIGS. 13*b* and 13*c* of the drawings. If any of the legs are not supporting weight, the support platform 50 will not be allowed to be released since at least one of the finger members 55 will be captured within the corresponding guide member 70 by the corresponding locking detent 57. The user will have to adjust the adjustment member 26 until each of the adjustment members 26 has sufficient and substantially equal weight supported by the same thereby causing the corresponding elongated shaft 88 to depress the corresponding locking detent 57. The user may test whether all of the finger members 55 are released by attempting to lift the support platform 50 upwardly a small distance.

Figure 10:
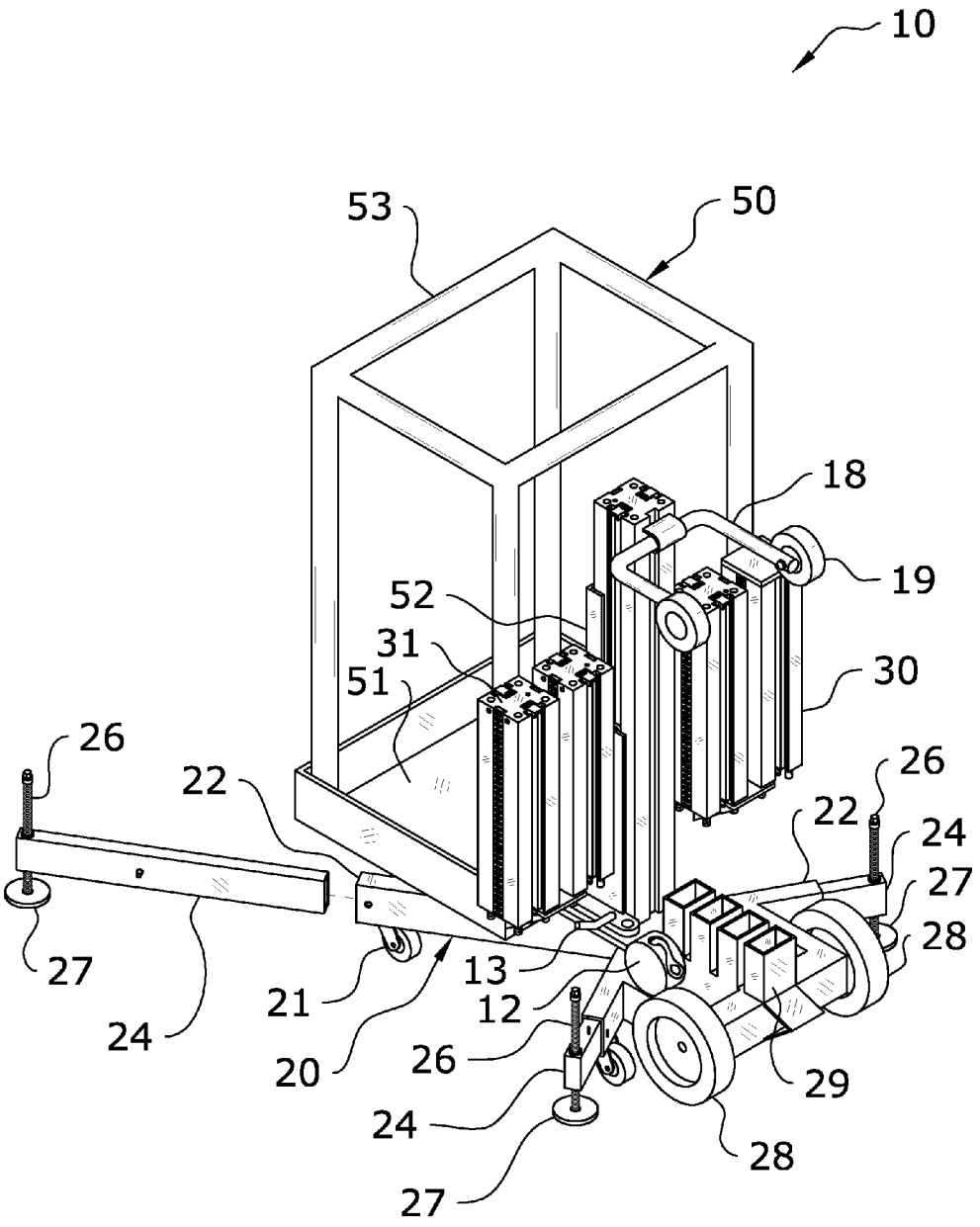
FIG. 10 is an upper perspective view of the outer leg removed from the inner leg.

After the user has tested the stability of the support base 20, the user may then enter the support platform 50 and begin assembly of the vertical mast with the mast sections 30 as shown in FIG. 2 of the drawings. To assemble the vertical mast, the user removes the proper mast section 30 from the mast storage device 58 while they are positioned within the support platform 50 and positions the second end 37 of the mast storage device 58 upon the first end 31 of the base mast section 30. The locking pins 38 extend into the receiver apertures 32 and the user then rotates the locking lever 46 thereby allowing rotating of the securing levers 40. With the locking lever 46 centrally located and aligned with the notch 42 within the corresponding securing levers 40, the user then rotates the securing levers 40 to rotate the locking shaft 44 to lock the locking pins 38 within the receiver apertures 32. The locking lever 46 is rotated back to the locked position to prevent movement of the securing levers 40 thereby ensuring the corresponding mast sections 30 will remain securely connected. The user is able to operate the drive unit 60 to elevate the support platform 50 onto the last assembled mast section 30 to allow for attachment of another mast section 30 above thereof. The process is continued for each of the remaining mast sections 30 until the vertical mast is completed as illustrated in FIG. 3 of the drawings. The user may then travel along the vertical mast with the support platform 50 as desired to perform their work. When the work is completed, the user then reverses the process by releasing the locking lever 46, releasing the securing levers 40 and removing each of the mast sections 30 (the sliding support 52 must be positioned beneath the connection point to be released before releasing the same). This process continues until the support platform 50 is fully lowered and all of the mast sections 30 have been removed and positioned within the mast storage device 58 as shown in FIG. 10 of the drawings. Once the finger members 55 are all fully extended into the guide members 70, the corresponding lower biased units 72 are corresponding forced downwardly by the same thereby lowering the flanged end member 74 to the lower broader portion of the slot 25 within the partition member 23 thereby allowing removal of the corresponding outer leg 24 (if the lower biased unit 72 is not fully lowered, then the corresponding outer leg 24 cannot be removed). Once the outer legs 24 are positioned in the storage position, the user may then transport the present invention to storage or another work location.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A portable lift, comprising:

a support base having a plurality of legs, wherein each of said plurality of legs respectively includes a distal portion and an inner portion;

a plurality of adjustment members, each of said plurality of adjustment members extending downwardly from each of said distal portions of said plurality of legs respectively and configured to move vertically between a first position which is disengaged from a support surface and a second position which engages the support surface;

a first lock member attached to said support base;

a vertical mast extending upwardly from said support base;

a support platform movably connected to said vertical mast, wherein said support platform is adapted to move upwardly and downwardly upon said vertical mast; and a second lock member attached to said support platform and adapted to mechanically connect to said first lock member;

wherein said first lock member in combination with said second lock member form a pair of locking members which are configured to move between a locked state and an unlocked state, wherein said locked state locks said pair of locking members together which locks said support platform to said base and prevents said support platform from moving along said mast, wherein said unlocked state has said pair of locking members unlocked from one another to allow movement of said support platform vertically along said mast, wherein said pair of locking members is configured to switch from said locked state to said unlocked state as a direct result of at least one of said plurality of adjustment members moving from said first position to said second position which moves an engaging member along a major length of a corresponding one of said plurality of legs to unlock said pair of locking members from one another.

2. The portable lift of claim 1, wherein said support base includes a plurality of wheels.

3. The portable lift of claim 2, wherein said portable lift is configured to be in the unlocked state when at least one of said plurality of wheels is elevated above said support surface.

4. The portable lift of claim 2, wherein said portable lift is configured to be in the unlocked state when all of said plurality of wheels are elevated above said support surface.

5. The portable lift of claim 1, wherein said plurality of adjustment members are capable of minimizing horizontal movement of said support base when at least one of said plurality of adjustment members is supporting weight from the portable lift in the unlocked state.

6. The portable lift of claim 1, wherein said plurality of adjustment members are capable of minimizing horizontal movement of said support base when all of said plurality of adjustment members are respectively supporting weight from the portable lift in the unlocked state.

7. The portable lift of claim 1, wherein said first lock member is comprised of a guide member having an inner passage capable of receiving the second lock member.

8. The portable lift of claim 7, wherein said second lock member is comprised of a finger member that is formed to slidably fit within said guide member.

9. The portable lift of claim 8, wherein said finger member includes a locking detent that catchably engages said guide member when in the locked state and said finger member is configured to pass through said guide member when in the unlocked state.

10. The portable lift of claim 9, wherein at least one of said plurality of adjustment members is configured to cause a mechanical engagement and release of said locking detent.

11. The portable lift of claim 10, wherein each of said plurality of legs is tubular and wherein said each of said plurality of adjustment members is slidably positioned within said plurality of legs.

12. The portable lift of claim 11, wherein each of said plurality of adjustment members respectively includes a first engaging member that is respectively capable of mechanically engaging a second engaging member.

13. The portable lift of claim 12, wherein at least one of said second engaging members is respectively adapted to mechanically engage said locking detent.

14. The portable lift of claim 1, wherein each of said plurality of adjustment members includes a pad attached to a lower end.

15. A portable lift, comprising:

a support base having a plurality of legs, wherein each of said plurality of legs respectively includes a distal portion and an inner portion;

a plurality of adjustment members, each of said plurality of adjustment members extending downwardly from each of said distal portions of said plurality of legs respectively and configured to move vertically between a first position which is disengaged from a support surface and a second position which engages the support surface;

a first lock member attached to said support base;

a vertical mast extending upwardly from said support base;

a support platform movably connected to said vertical mast, wherein said support platform is adapted to move upwardly and downwardly upon said vertical mast; and a second lock member attached to said support platform and adapted to mechanically connect to said first lock member;

wherein said first lock member in combination with said second lock member form a pair of locking members which are configured to move between a locked state and an unlocked state, wherein said locked state locks said pair of locking members together which locks said support platform to said base and prevents said support platform from moving along said mast, wherein said unlocked state has said pair of locking members unlocked from one another to allow movement of said support platform vertically along said mast, wherein said pair of locking members is configured to switch from said locked state to said unlocked state as a direct result of at least one of said plurality of adjustment members moving from said first position to said second position which moves an engaging member with respect to said support base to unlock said pair of locking members from one another.

16. A portable lift, comprising:

a support base having distal portion and inner portions; a plurality of adjustment members extending downwardly from said distal portions of said support base and configured to move vertically between a first position which is disengaged from a support surface and a second position which engages the support surface;

a first lock member attached to said support base;

a vertical mast extending upwardly from said support base;

a support platform movably connected to said vertical mast, wherein said support platform is adapted to move upwardly and downwardly upon said vertical mast; and a second lock member attached to said support platform and adapted to mechanically connect to said first lock member;

wherein said first lock member in combination with said second lock member form a pair of locking members which are configured to move between a locked state and an unlocked state, wherein said locked state locks said pair of locking members together which locks said support platform to said base and prevents said support platform from moving along said mast, wherein said unlocked state has said pair of locking members unlocked from one another to allow movement of said support platform vertically along said mast, wherein said pair of locking members is configured to switch from said locked state to said unlocked state as a direct result of at least one of said plurality of adjustment members moving from said first position to said second position which moves an engaging member along a major length of said support base to unlock said pair of locking members from one another.

17. The portable lift of claim 16, wherein said support base is comprised of a plurality of legs extending outwardly from a central location.

18. The portable lift of claim 16, wherein said support base includes a plurality of wheels.

19. The portable lift of claim 18, wherein said portable lift is configured to be in the unlocked state when at least one of said plurality of wheels is elevated above said support surface.

20. The portable lift of claim 18, wherein said portable lift is configured to be in the unlocked state when all of said plurality of wheels are elevated above said support surface.

* * * * *